US011512535B2

(12) United States Patent
Elliot

(10) Patent No.: US 11,512,535 B2
(45) Date of Patent: Nov. 29, 2022

(54) DUAL ROTARY ELEVATING GEOTECHNICAL DRILL

(71) Applicant: BENTHIC USA LLC, Houston, TX (US)

(72) Inventor: Robert Elliot, Houston, TX (US)

(73) Assignee: BENTHIC USA LLC, Houston, TX (US)

( * ) Notice: Subject to any disclaimer, the term of this patent is extended or adjusted under 35 U.S.C. 154(b) by 0 days.

(21) Appl. No.: 17/057,757

(22) PCT Filed: May 23, 2019

(86) PCT No.: PCT/US2019/033786
§ 371 (c)(1),
(2) Date: Nov. 23, 2020

(87) PCT Pub. No.: WO2019/226913
PCT Pub. Date: Nov. 28, 2019

(65) Prior Publication Data

US 2021/0246728 A1 Aug. 12, 2021

Related U.S. Application Data

(60) Provisional application No. 62/675,967, filed on May 24, 2018.

(51) Int. Cl.
*E21B 3/02* (2006.01)
*E21B 7/124* (2006.01)
(Continued)

(52) U.S. Cl.
CPC ..... *E21B 7/124* (2013.01); *E21B 3/022* (2020.05); *E21B 7/20* (2013.01); *E21B 15/02* (2013.01);
(Continued)

(58) Field of Classification Search
CPC . E21B 3/02; E21B 3/022; E21B 7/124; E21B 7/20; E21B 15/02; E21B 19/002;
(Continued)

(56) References Cited

U.S. PATENT DOCUMENTS 3,519,071 A * 7/1970 Word, Jr. ..... E21B 33/035 166/351
3,741,320 A 6/1973 Hilfing
(Continued)

FOREIGN PATENT DOCUMENTS

EP 1980709 A1 * 10/2008 ..... E21B 19/14
WO 0121929 A1 3/2001
(Continued)

*Primary Examiner* — Matthew R Buck
(74) *Attorney, Agent, or Firm* — Dickinson Wright PLLC; Andrew D. Dorisio

(57) ABSTRACT

An apparatus is configured for undersea use, such as for penetrating a seabed for forming a borehole therein, including with optional data acquisition and logging capabilities. A first or base module (12) of the apparatus is adapted for engaging the seabed. A first elevator (16) provides longitudinal movement of a second or upper module (14) relative to the base module (12) along a drilling axis. The relative movement of the upper and base modules may be used in the course of independently moving first (18) and second (20) rotary units along the drilling axis to cause a drill rod (R) and a drill casing (C) to penetrate the seabed such that the collapse of the borehole is avoided.

26 Claims, 39 Drawing Sheets

(51) Int. Cl.

| | |
|---|---|
| ***E21B 7/20*** | (2006.01) |
| ***E21B 15/02*** | (2006.01) |
| ***E21B 19/00*** | (2006.01) |
| ***E21B 41/04*** | (2006.01) |
| ***E21B 19/07*** | (2006.01) |
| ***E21B 49/02*** | (2006.01) |

(52) U.S. Cl.
CPC ..... *E21B 19/002* (2013.01); *E21B 19/07* (2013.01); *E21B 41/04* (2013.01); *E21B 49/025* (2013.01)

(58) Field of Classification Search
CPC ..... E21B 19/07; E21B 41/04; E21B 25/18; E21B 49/025
See application file for complete search history.

(56) References Cited

U.S. PATENT DOCUMENTS

| | | | | |
|---|---|---|---|---|
| 6,394,192 | B1 * | 5/2002 | Frazer | E21B 7/124 175/58 |
| 7,584,796 | B2 * | 9/2009 | Ayling | E21B 7/124 166/358 |
| 7,703,534 | B2 * | 4/2010 | Sheshtawy | E21B 15/02 166/358 |
| 8,757,289 | B2 * | 6/2014 | Bauer | E02D 27/52 175/6 |
| 9,909,377 | B2 * | 3/2018 | Finkenzeller | E21B 25/18 |
| 2013/0206476 | A1 | 8/2013 | Innes et al. | |
| 2013/0220699 | A1 | 8/2013 | Bauer et al. | |
| 2015/0315860 | A1 | 11/2015 | Looijen | |

FOREIGN PATENT DOCUMENTS

| | | | | |
|---|---|---|---|---|
| WO | WO-2009157762 | A1 * | 12/2009 | E21B 7/124 |
| WO | WO-2013065013 | A2 * | 5/2013 | E21B 7/124 |
| WO | WO-2017108098 | A1 * | 6/2017 | E21B 19/143 |

* cited by examiner

DUAL ROTARY ELEVATING GEOTECHNICAL DRILL

This application claims the benefit of U.S. Provisional Patent Application Ser. No. 62/675,967, the disclosure of which is incorporated herein by reference.

TECHNICAL FIELD

This disclosure relates to geotechnical sampling and testing of underwater sites and, in particular, where installation of casing is desirable to keep a borehole open in difficult, collapsing ground conditions.

BACKGROUND

The use of remotely operated drilling equipment for geotechnical investigation of underwater sites is becoming increasingly commonplace, both for physical soil sampling by coring techniques and for in situ measurement of soil properties using downhole instrumentation. Such equipment in the so-called 'tethered seabed landing platform' category is referenced, for example, in U.S. Pat. Nos. 6,394,192 and 9,322,220, the disclosures of which are incorporated herein by reference. These drilling units operate over a wide range of water depths from less than 20 m to beyond 3000 m and carry tooling capacities to penetrate up to 150 m below mudline. They are deployed and remotely controlled from a surface vessel via an umbilical that provides lifting, power and communications functions. Drilling techniques may use conventional tooling or wireline systems.

Current seabed drills rely on operating with a single rotary unit, which is adequate in good ground conditions to achieve a range of drilling, casing, rotary core sampling, piston coring, cone penetrometer test (CPT) and other in situ test capabilities. However, for non-wireline operation, difficult ground conditions such as dense sands, hard clays, chalk and other geologies typical of shallow water offshore environments present numerous technical challenges due to borehole instability. Collapse of unconsolidated material can severely limit productivity and the ability to complete boreholes to target depth.

Known practices to counteract borehole collapse include installation of casing that allows the drill string and attached tooling to pass through, and the use of drilling mud to keep the unsupported section open when drilling ahead to recover soil samples or advance the borehole into virgin ground. This is often unsuccessful as unsupported ground can collapse into the borehole as soon as the core barrel is withdrawn or the drill string is removed in order to advance the next section of casing using the single rotary drive. This necessitates a washbore cycle to attempt clean-out of the collapsed material and advance the casing to virgin ground in preparation for the next core sampling cycle, or closest drill depth in multiples of a casing length segment. The casing is often unable to be advanced to the required depth as the mud and drill water system is unable to clear and return cuttings effectively.

Likewise, the need to install casing with only a single rotary drive available is disadvantageous to productivity of continuous CPT operation. The entire drill string and CPT tool must be repeatedly tripped out each time to washbore material from the collapsed section of borehole, after setting casing to closest depth as possible to virgin ground ready for the next CPT push.

Certain commercially available terrestrial drilling rigs, for example the Foremost DR-series Drills, overcome the problem of borehole collapse by the use of dual rotary units. Mounted on a single elevator mast, an upper rotary handles the drill string and a lower rotary handles casing, each operating independently at set rates and relative position to one other. This allows the casing to keep pace closely with the drill bit in advancing the borehole or even work slightly ahead to counteract borehole collapse and maintain efficient cuttings removal. This arrangement requires a very tall tool elevator mast to provide the length of movement of the rotary units necessary to add or remove drill rods and casing sections on the common drilling axis. Such an arrangement is impractical for storage and automatic handling of drill tools on a remotely operated rig, particularly where it is desirable to provide a compact configuration for containerized transport and launch/recovery using a shipboard system.

Accordingly, a need is identified for providing a remotely operated dual rotary geotechnical drill in a compact containerized format, with the capability to run drilling, sampling or CPT tools in a borehole while concurrently advancing casing to support the borehole to virgin ground at any depth. A need is also identified to provide the functionality to allow a CPT tool that is configured in combination with a casing/washbore tool to be run in a continuous sequence.

SUMMARY

According to one aspect of the disclosure, a drill assembly configured for remote control for underwater use includes a modular structure comprising a base support module, referred to as the Drill Elevating Platform, or DEP, and an upper module, referred to as the Drill Main Module, or DMM. The DMM and DEP are arranged on a common drilling axis and the DMM is moveable longitudinally on this axis in relation to the DEP by attached DEP hydraulic elevating cylinders. The separation distance between the DMM and DEP modules is adjustable to any position between a fully retracted and fully extended state, and may be commensurate with the length of one casing section or drill rod. This operability provides an advantageous arrangement whereby a tool magazine and loader of compact height (working with tools typically 3 m in length, as an example) is sufficient for concentric robotic handling of casing and drill strings.

The DEP elevating cylinders are sufficiently robust and large enough in diameter and overall length to provide rigidity at full extension and to handle side loads when the drill unit is lifted horizontal in its transport position.

The DMM includes a conventional upper rotary unit and chuck assembly mounted on an elevator carriage and a lower rotary unit and chuck assembly mounted at the base of the DMM in the same orientation and on the same axis as the upper rotary. The lower rotary is essentially identical to the upper rotary, except it has a through shaft in place of the usual center water coupling. The dual rotary units feed independently and with the ability for left or right hand rotation. While both chuck assemblies may be identical, the upper rotary and chuck assembly can handle all types of tooling (drill rods, washbores, casings, core barrels, CPT assemblies, and CPT rods), while the lower rotary and chuck assembly is primarily intended to handle casings. The upper rotary and chuck assembly includes a rotary coupling through which drilling fluid is pumped to the bottom of the drill string. The rotary coupling accommodates tools of different diameters—casing, drill rods and CPT rods—and effectively seals the top of the string for the supply of drilling fluid (commonly seawater) to the cutting bit.

The assembly and, in particular, the DMM may also include a known type of robotic tool handling system comprising one or more magazines carrying one or more of tools, loading arms, alignment guides, a rod clamp, mud box, and associated mechanical, hydraulic, control and communications systems. The tool magazines are removable for standard containerized transport. For CPT and other types of downhole instrumentation, a known technique of real-time acoustic data transmission via the drill string may be utilized, as described in U.S. Pat. No. 8,773,947, the disclosure of which is incorporated herein by reference.

The assembly and, in particular, the DEP module has legs and feet structures that are foldable against the DMM into a containerized package for transportation and for compact handling during launch and recovery procedures. A casing clamp attached at the base of the DEP is provided to hold the casing stationary in the borehole while the DMM is being raised by extension of the DEP elevating cylinders. The DEP casing clamp is identical to the DMM rod and casing clamps.

Other features of the DEP module include a power and communications electronics pressure can, and a hydraulic system comprising a reservoir, manifolds and pump to power the legs and elevating cylinders. Alternatively, hydraulic power may be supplied to the DEP directly from the DMM. To accommodate the movement and variable distance between the retracted and extended positions of the DEP and DMM, a folding energy chain assembly secures and guides the necessary hydraulic lines, power and communications cables.

It will become evident from the following description and method of operation that the dual rotary DMM-DEP system affords significant productivity improvements when working in difficult unconsolidated ground conditions. Some key advantages are:

- Ability to set casing at any depth (not just at whole multiples of casing length), so the borehole is always supported to virgin ground.
- Ability to rotate and advance drill casing and drill string independently and/or at the same time.
- Ability to 'chase' the drill string with the casing, potentially removing/reducing the need to washbore between sampling runs.
- Casing can be continuously rotated, even while adding a rod to the drill string, reducing set up of casing and cuttings in the annulus.
- Ability to chase a CPT with a washbore/casing, allowing 'continuous' CPT sampling in up to 100 MPa ground conditions.
- Ability to add casing to an outer chasing washbore/casing without having to remove the CPT string from the borehole first. This greatly improves productivity of continuous CPT operations, especially as the borehole progresses in depth and in all situations of difficult ground conditions.
- With access to additional claims onto the drill string that can be elevated, at least double the pull out force with the DEP elevating cylinders when pulling out casing, compared to the limit with a single rotary on a stand-alone DMM.
- Potentially utilize the full weight of the DMM for CPT push in resistant ground, without risk of destabilising the unit on its footings, as in the case of a stand-alone DMM.

Additional, yet presently unrecognized advantages may also flow from the concepts disclosed herein and, thus, the foregoing list is not in any way intended to be exhaustive.

BRIEF DESCRIPTION OF THE DRAWING FIGURES

The accompanying drawing figures incorporated herein and forming a part of the specification, illustrate several aspects of a dual rotary geotechnical drill assembly according to the disclosure and, together with the description, serve to explain certain principles thereof. In the drawing figures.

Reference will now be made in detail to the present preferred embodiments of a dual rotary geotechnical drill assembly, examples of which are illustrated in the accompanying drawing figures.

DETAILED DESCRIPTION

Figure 1:
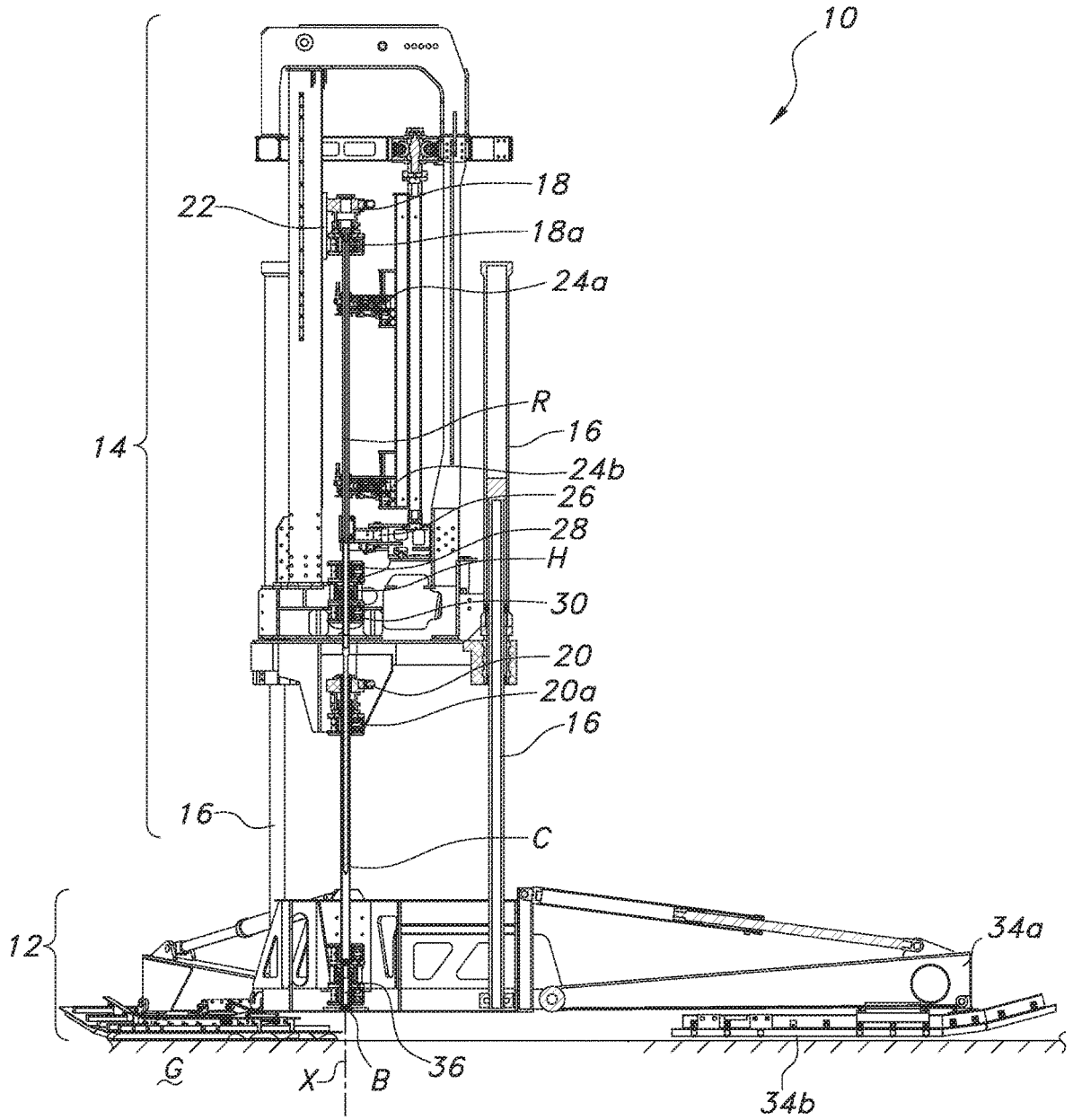
FIG. 1 shows a general cross-sectional side view of a dual rotary geotechnical drill assembly.
Figure 6:
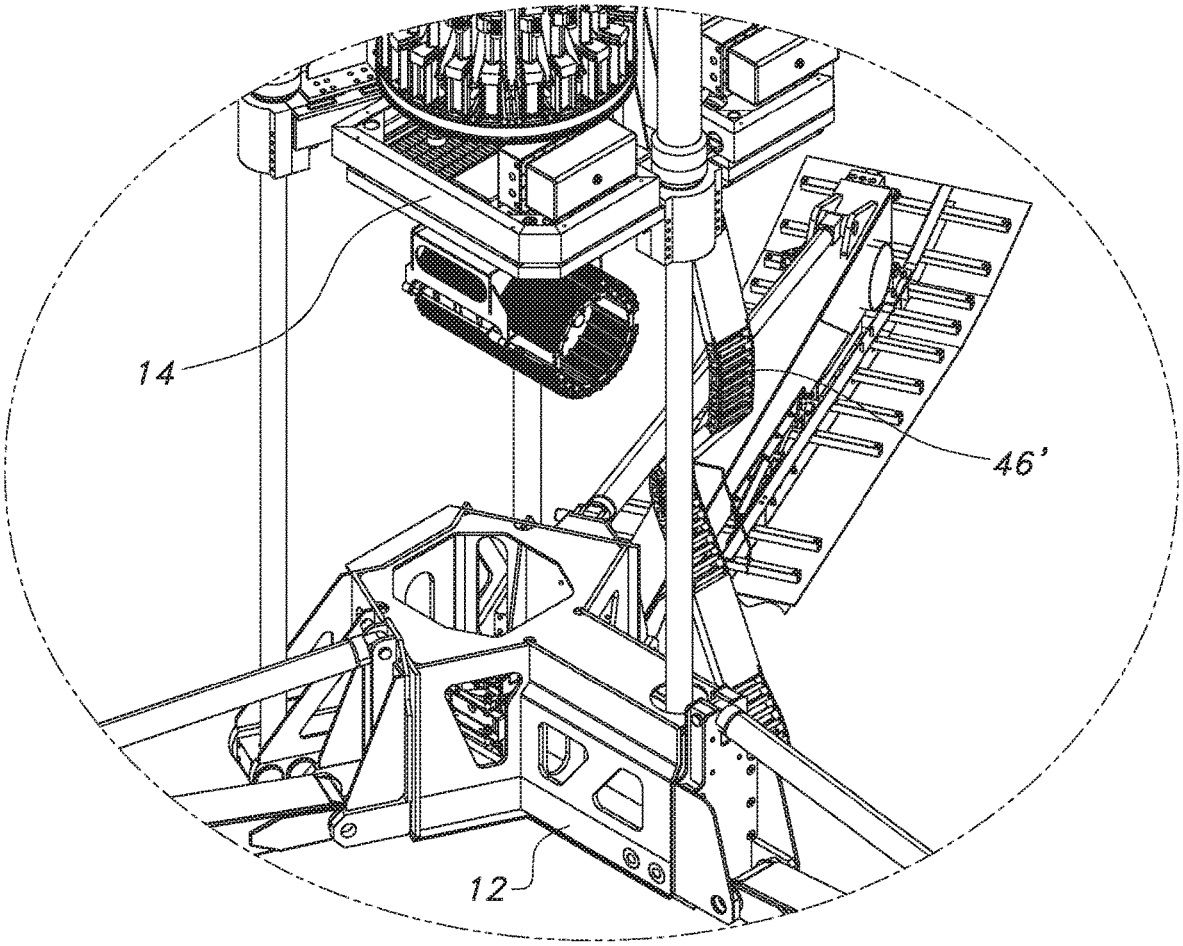
FIGS. 6 and 6A show an example of a folding energy chain accommodating movement in hydraulic and electrical lines between the DEP and DMM assemblies (extended and retracted)
Figure 6A:
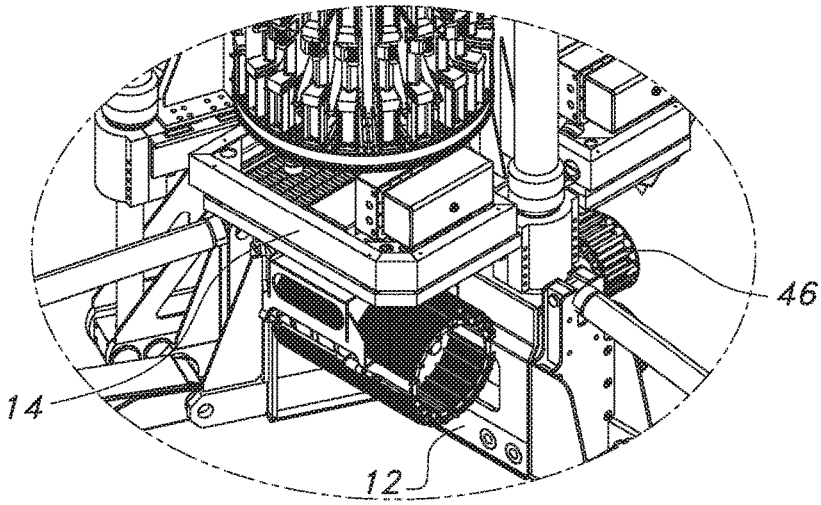

As illustrated in FIG. 1, the disclosure pertains to a remotely operated drill assembly 10 configured for underwater use for penetrating the ground G, which may comprise a seabed (which is intended to include any undersea surface in need of penetration). In the illustrated embodiment, the unit comprises a base support assembly referred to as the Drill Elevating Platform, or "DEP," module 12 and a first or upper drill assembly referred to as the Drill Main Module, or DMM 14. An elevator, such as one formed of one or more actuators in the form of hydraulic elevating cylinders 16 (three shown as illustrative for example FIG. 3 and FIG. 6), is provided between the DEP 12 and DMM 14 and, in the illustrated embodiment, serves to connect them. The elevator formed thus serves to provide longitudinal movement, or elevation, of the DMM 14 in relation to the DEP 12 on a common drilling axis X. The distance between DEP 12 and DMM 14 is adjustable to any position between a fully retracted state (10 in FIG. 2) and a fully extended state (10' in FIG. 3), which may be commensurate with the length of one drill tool for penetrating the seabed G (e.g., a casing section C, as shown in FIG. 1, which as described further below may receive another drill tool, such as a rod R).

The actuators, such as DEP elevator cylinders 16, are sufficiently robust and large enough in diameter and overall length to provide rigidity at full extension and to handle side loads when the drill unit is lifted horizontal in its transport position, and also to effectively resist rotation torque of rotary units 18 and 20, which may be associated with the assembly and, as noted below may form part of the DMM 14 in the illustrated embodiment.

Referring to FIG. 1, the first rotary unit 18 is associated with a further actuator, such as an elevator 22 (e.g., an elongated cylinder or other type of linear actuator) for being raised and lowered. The second rotary unit 20 (associated with a chuck or clamp 20*a*) may be mounted at the base of the DMM 14 in the same orientation and on the same drilling axis X as the first rotary unit 18. The second rotary unit 20 may be essentially identical to first rotary unit 18 (also including a clamp or chuck 18*a*), except it has a through shaft of suitable internal dimension to allow casing to pass through, in place of a center water coupling. The first rotary unit 18 and second rotary unit 20 operate independently and with the ability for left- or right-hand rotation.

The DMM 14 may also include a known robotic tool handling system comprising one or more loading arms, such as upper and lower arms 24*a*, 24*b*, alignment guides 26, a rod clamp 28, a casing clamp 30 and one or more tool magazines 32 (see FIG. 2) holding a mix of items, including but not limited to drill rods, casings, core barrels, washbore tools, CPT probes and CPT rods. The jaws of arms 24*a*, 24*b* and alignment guides 26 are profiled to accommodate the range of tool diameters from CPT rods to casings, held at the same axis.

Figure 2:
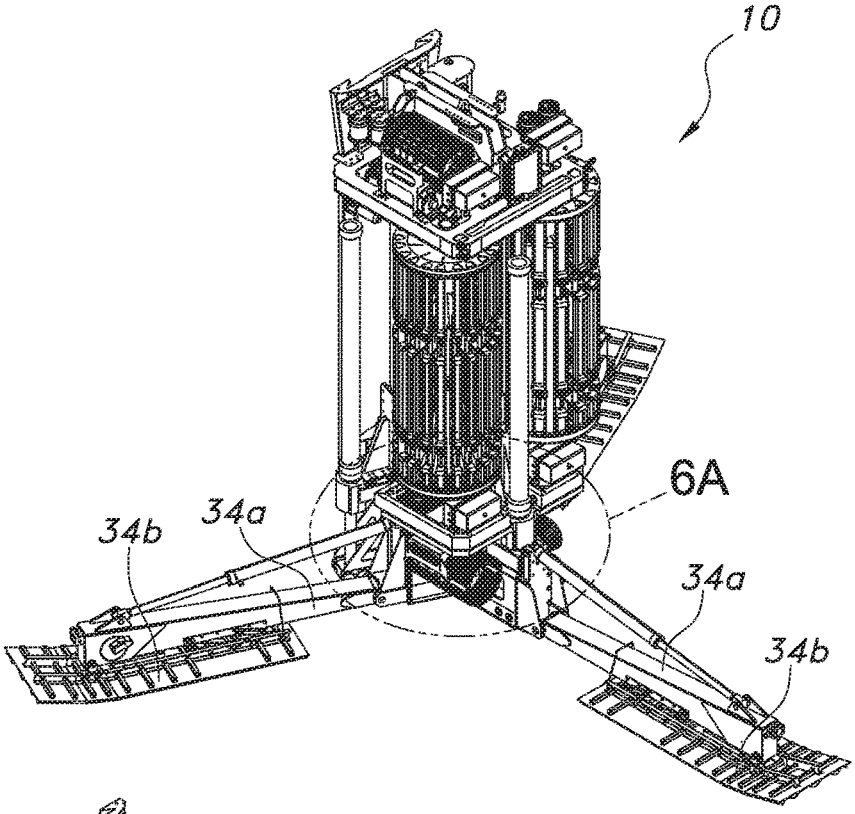
FIGS. 2 and 3 show perspective views of the DEP and DMM positions (retracted and extended)
Figure 3:
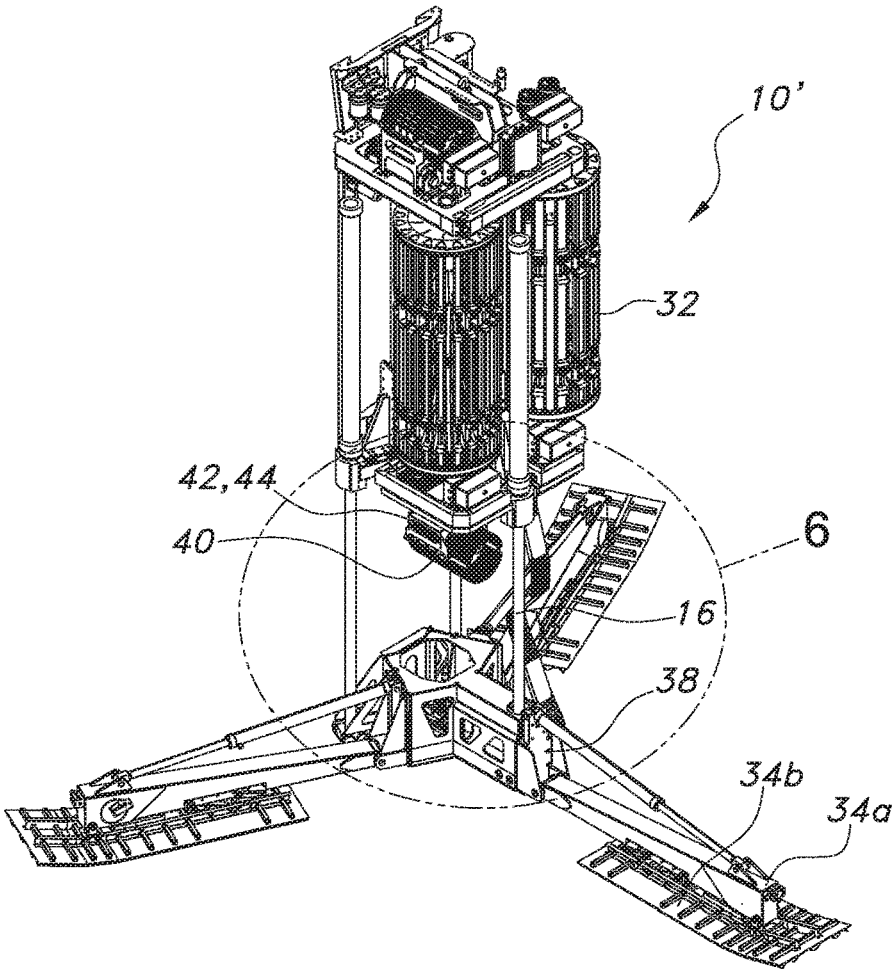
Figure 4:
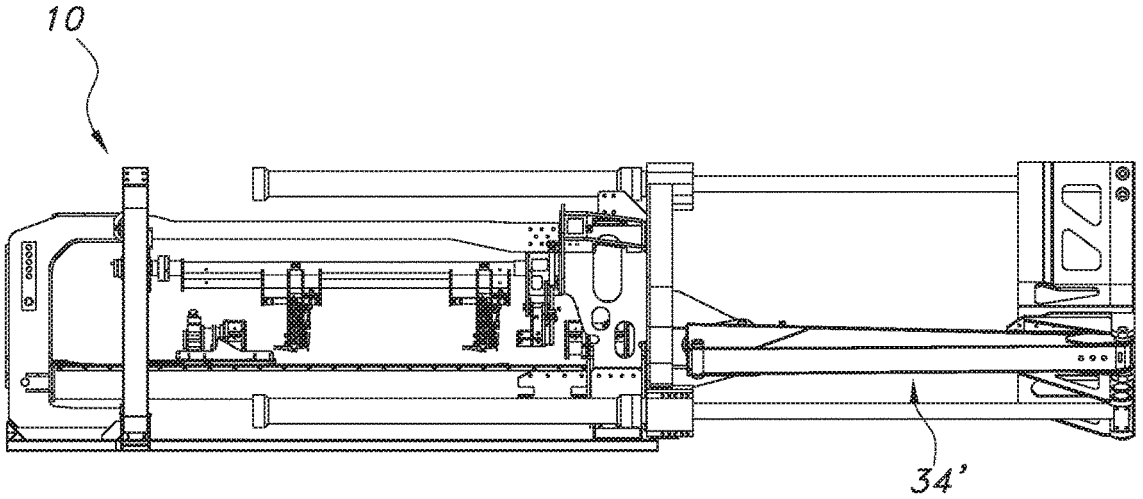
FIG. 4 shows the DMM-DEP assembly configured for transportation.
Figure 5:
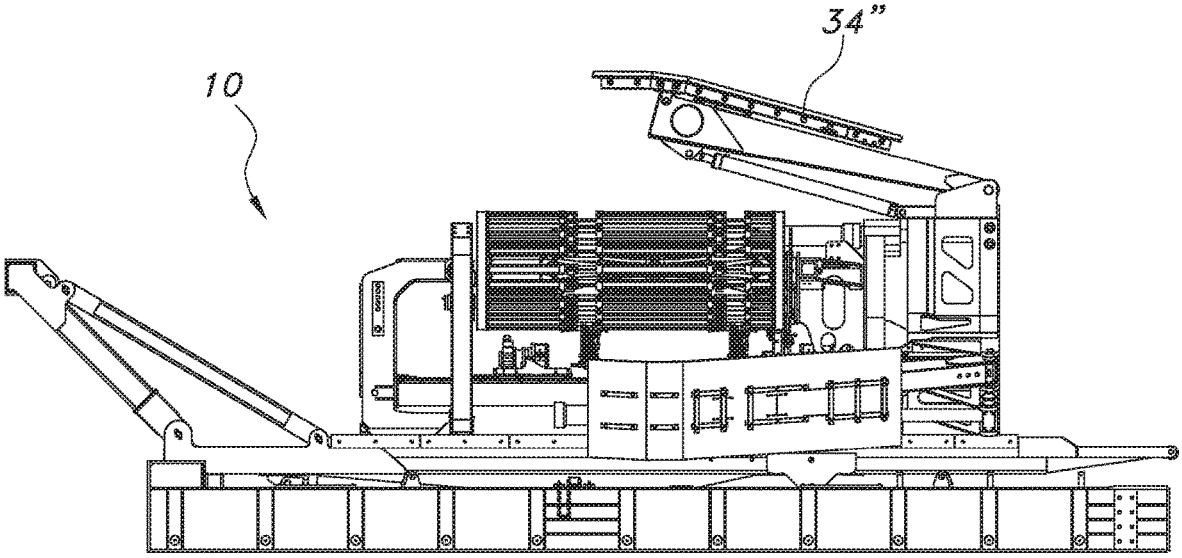
FIG. 5 shows an example of the DMM-DEP assembly positioned on a Launch and Recovery System.

As shown in FIGS. 1, 2, and 3, the DEP 12 may include legs 34*a* and associated feet 34*b* for engaging the seabed G. These structures may be foldable to allow the assembly 10 to be containerized within the envelope of a standard flat rack shipping container for transport (FIG. 4, 34', and also showing one of the feet 34*b* removed for transport purposes), or foldable against the DMM 14 in a compact configuration during launch and recovery (34", FIG. 5).

Referring again to FIG. 1 and FIG. 2, a DEP casing clamp 36 holds casing stationary in the borehole, including while the DMM 14 is being elevated by the actuator(s) (cylinders 16). An electronics pressure can 38 contains power and communications componentry, and a hydraulic system comprising reservoir 40, manifolds 42 and pump 44, powers legs 34*a* and elevator cylinders 16. Alternatively, hydraulic power may be supplied to the DEP 12 directly from the DMM 14. To accommodate the movement and variable distance between the retracted and extended positions of the DEP 12 and the DMM 14, a folding energy chain assembly 46 depicted in FIGS. 6 (extended 46') and 6A (retracted 46) secures and guides necessary hydraulic lines and power and communications cables.

Figure 7:
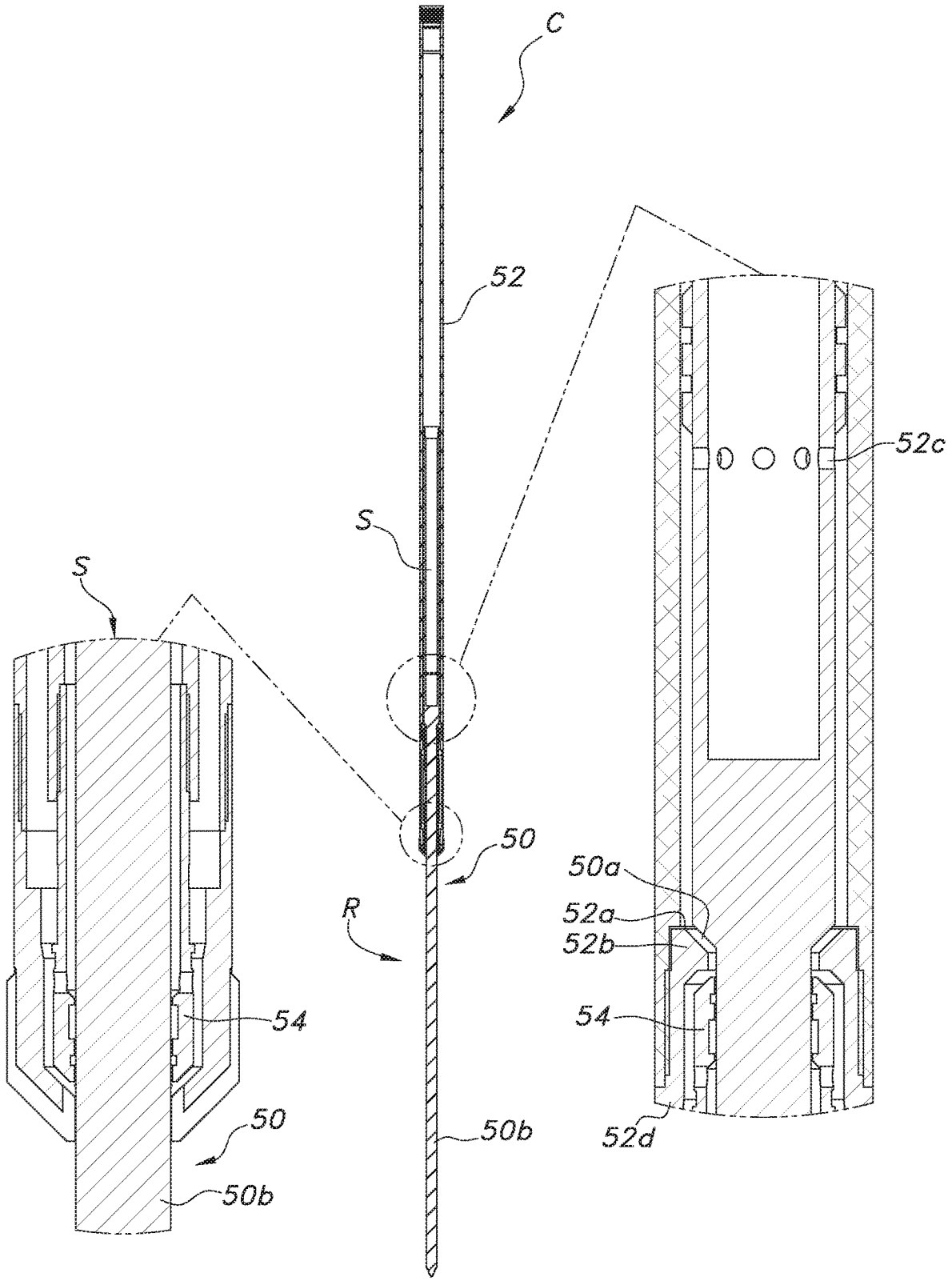
FIG. 7 shows cross-sectional views of a CPT and washbore casing tool assembly for continuous CPT operation with the DMM-DEP system.
Figure 16:
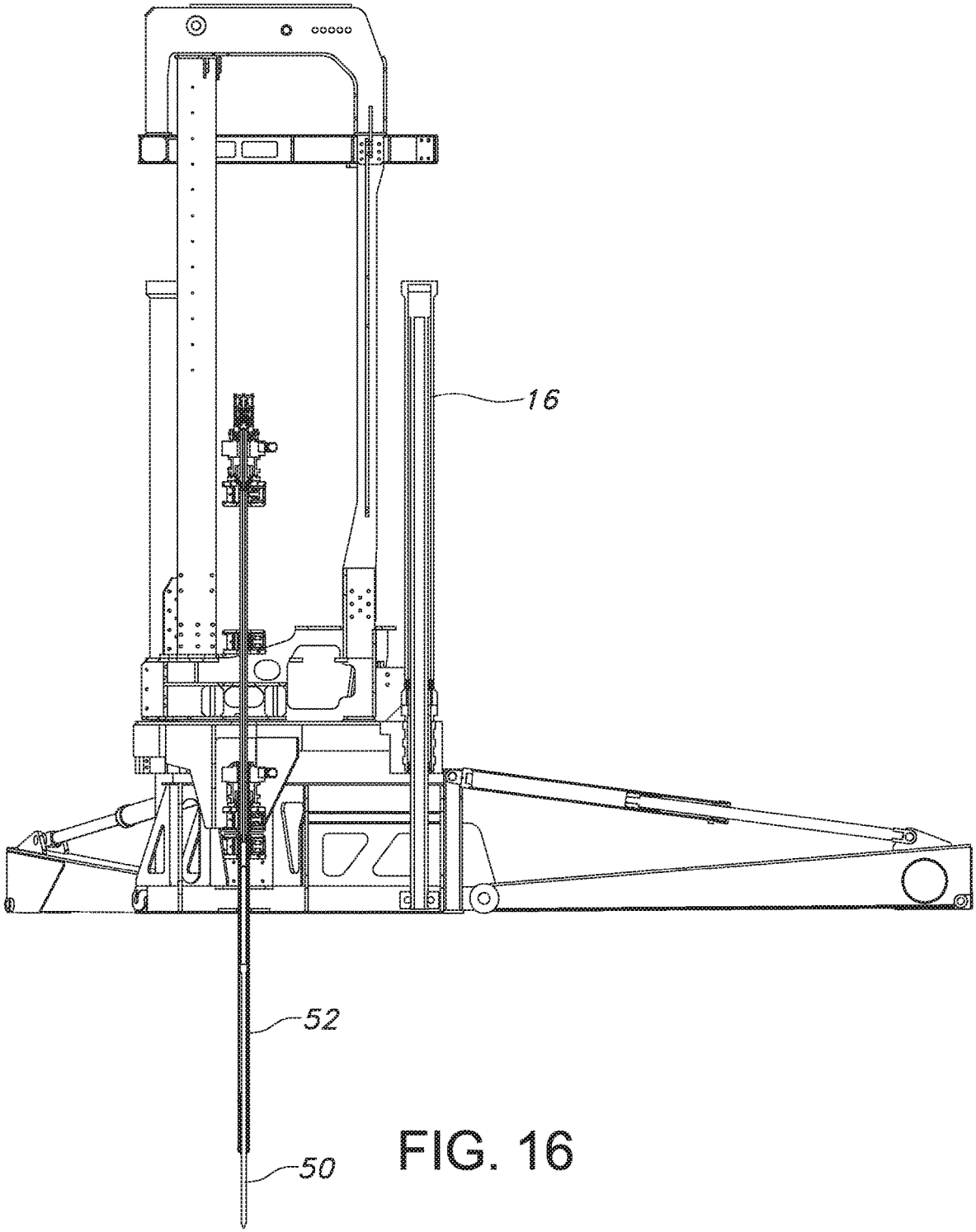
Figure 16A:
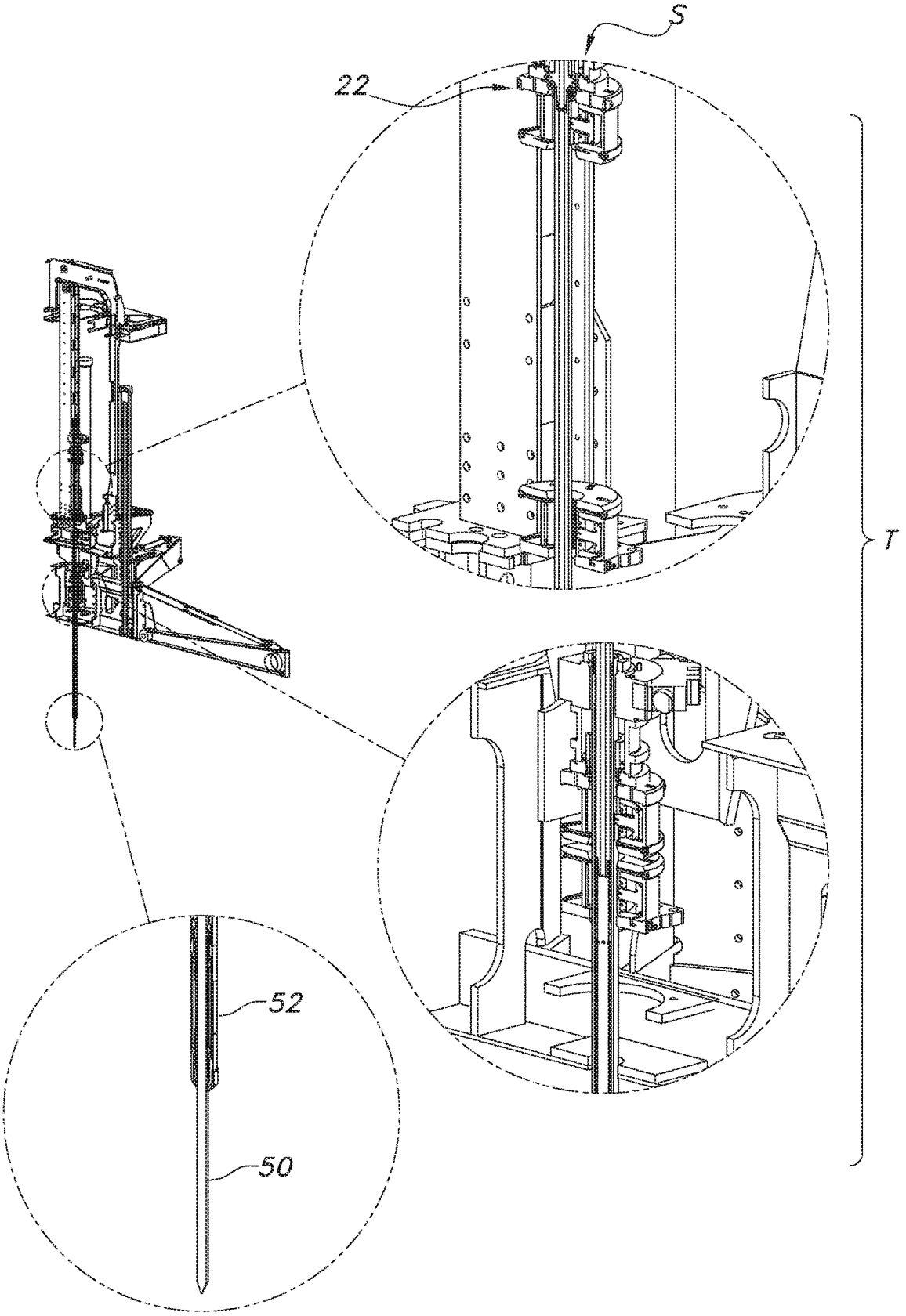

The assembly 10 including the DMM-DEP 12, 14 affords the opportunity to add casing to a string without the need to withdraw a drill (CPT) string from the borehole, thus greatly improving productivity of continuous drilling or CPT operations, especially as borehole depth increases and in situations of difficult ground conditions. As depicted in FIG. 7, the first drill tool, or rod R, may comprise a continuous CPT tool 50, which has a shoulder 50*a* tapering from the standard (e.g., 36 mm) diameter of the CPT probe assembly 50*b* to the larger diameter of the CPT sub section and string S that fits within CPT washbore tool 52 and CPT casing string T (see, e.g., FIG. 16A). A mating tapered shoulder 52*a* on the inside edge of the CPT washbore bit 52*b* retains CPT string S when it is released from the chuck on first rotary unit to allow another CPT casing length to be added.

Drilling fluid may be supplied by downward flow in hollow CPT string S to CPT washbore bit 52*b*, via passages 52*c* from CPT tool 50 and outwardly directed to the cutting face 52*d*. As noted herein, an optional bearing 54 may also be provided between the CPT tool 50 and the washbore casing 52 to help maintain proper alignment during penetration of the seabed.

Exemplary Sequence of Operational Events

It should be noted that in the following descriptive sequence, the dimensions given for the various tools and operational positioning are by way of example only. The sequence steps may be performed manually or automatically, such as by software control, and in either case monitored on a display including a graphical user interface by the drilling operator.

Running a Continuous CPT

This involves use of the assembly 10 in connection with a first drill tool or casing C, referred to as the CPT washbore tool 52 and a second drill tool or rod, referred to as a continuous CPT tool 50 depicted in FIG. 7 operated in the sequence of steps illustrated in FIGS. 8-24.

Figure 8:
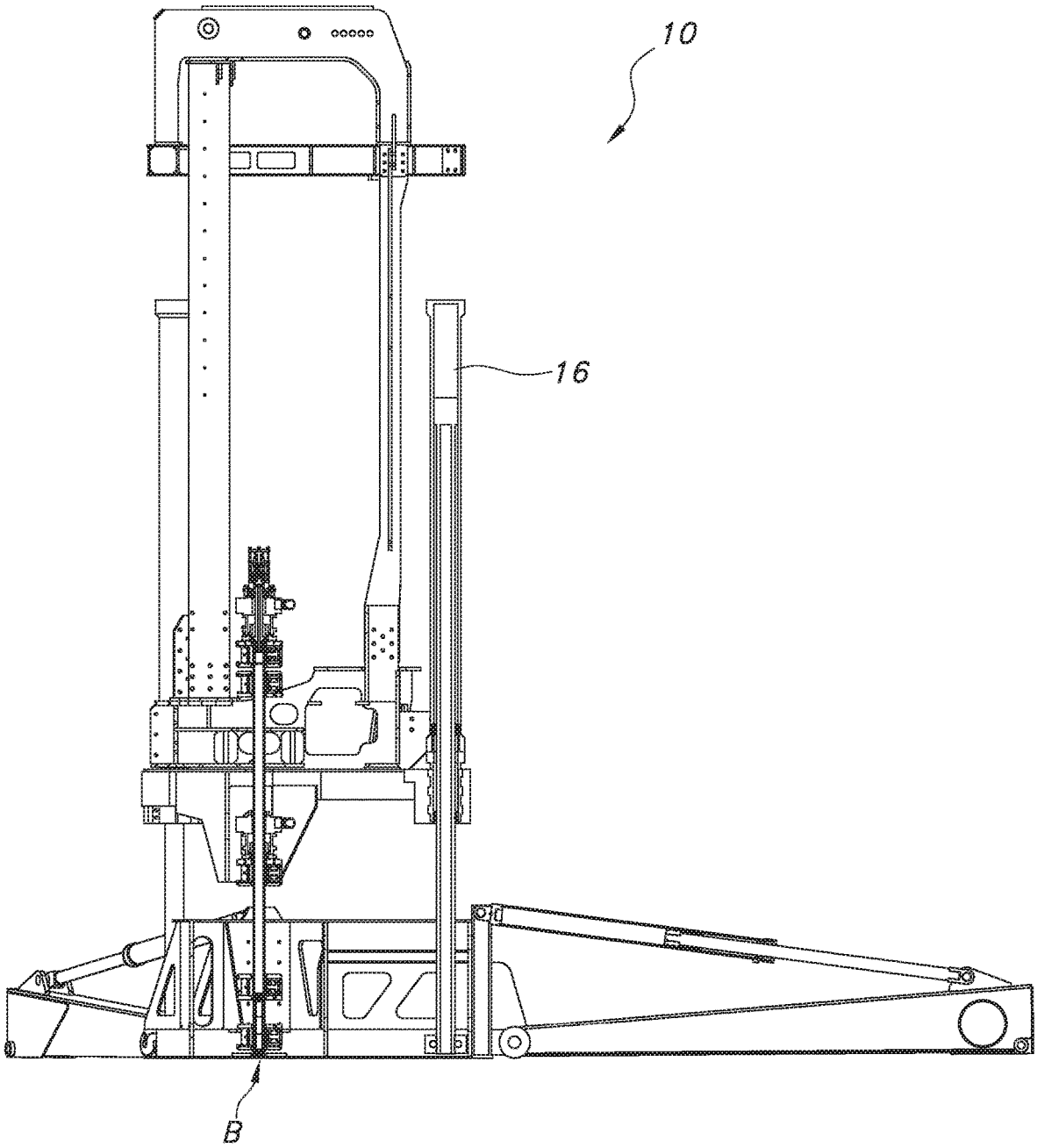
FIGS. 8-8A, 9-9A, 10-10A, 11-11A, 12-12A, 13-13A, 14-14A, 15-15A, 16-16A, 17-17A, 18, 18A, 19-19A, 20-20A, 21-21A, 22-22A, 23-23A, and 24-24A show an example of a continuous CPT method in a step sequence according to the disclosure.
Figure 8A:
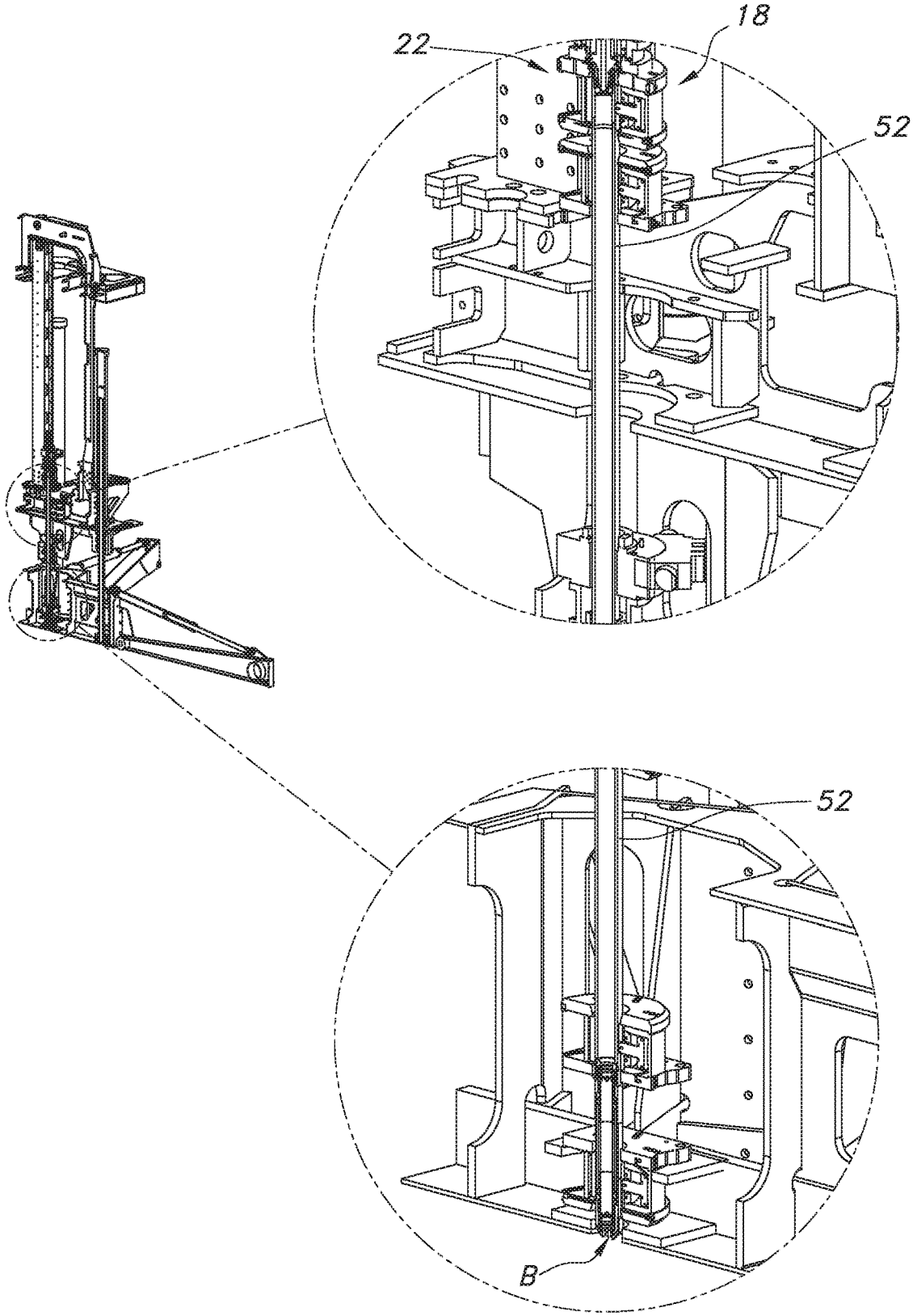
Figure 9:
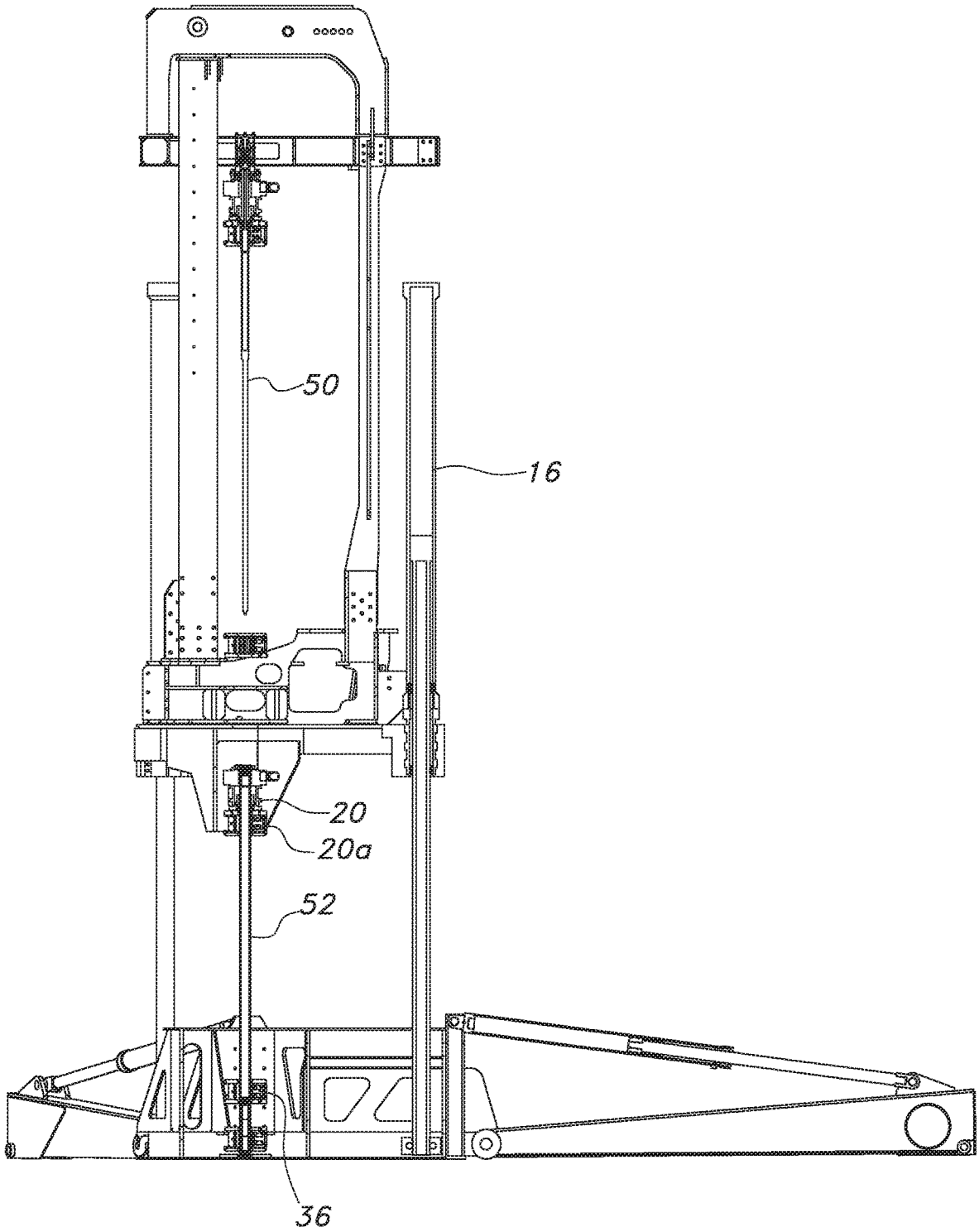
Figure 9A:
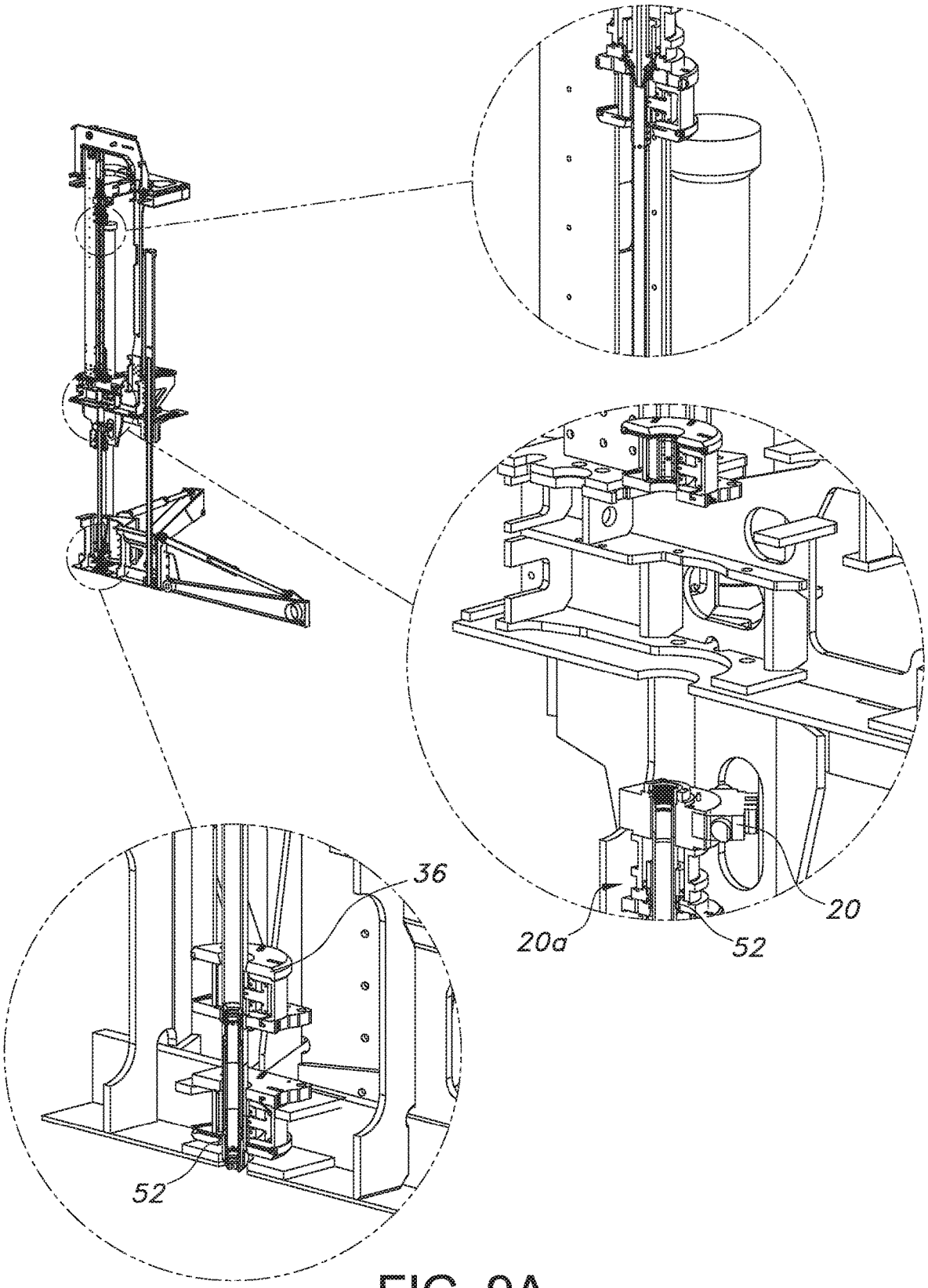
Figure 10:
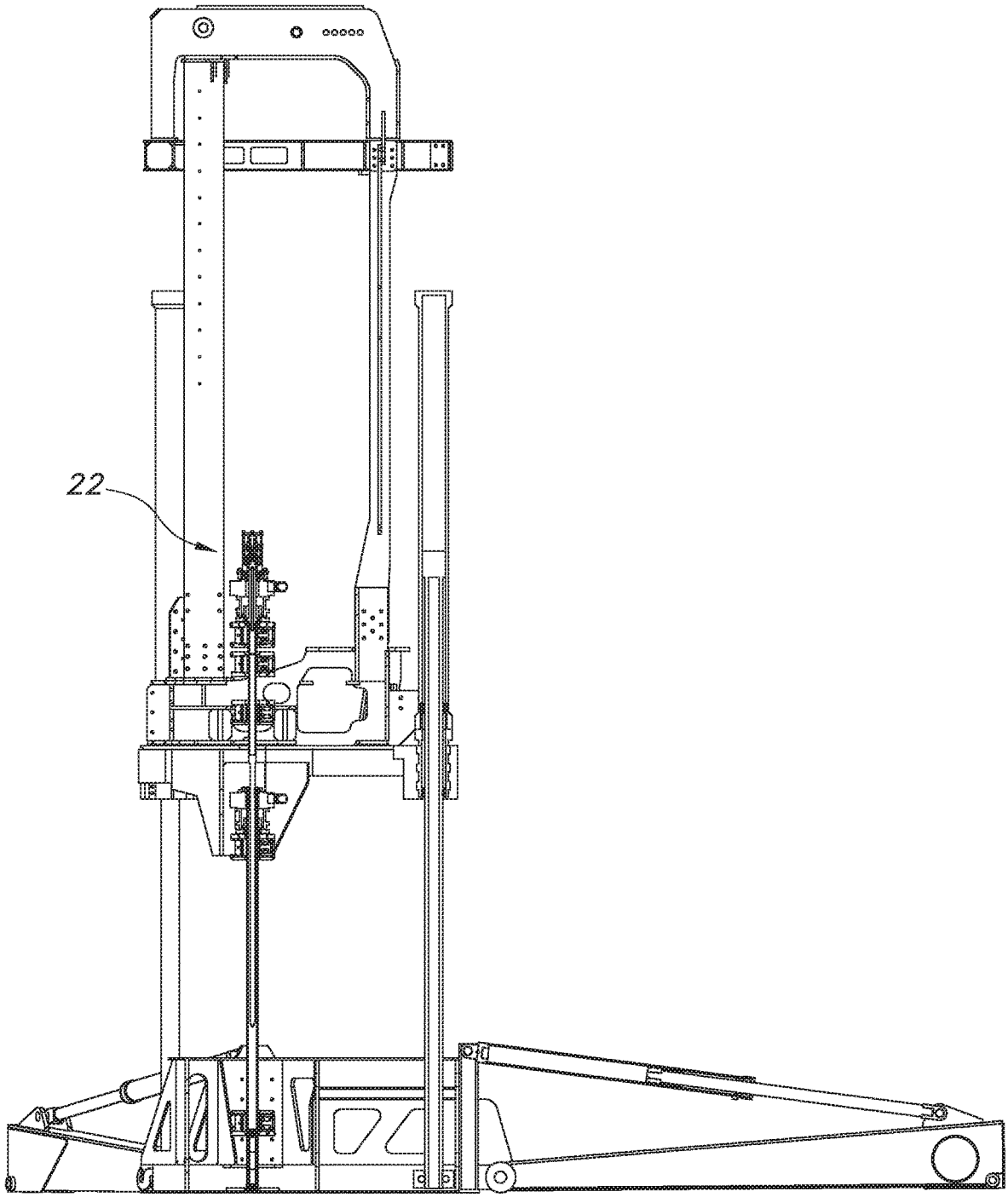
Figure 10A:
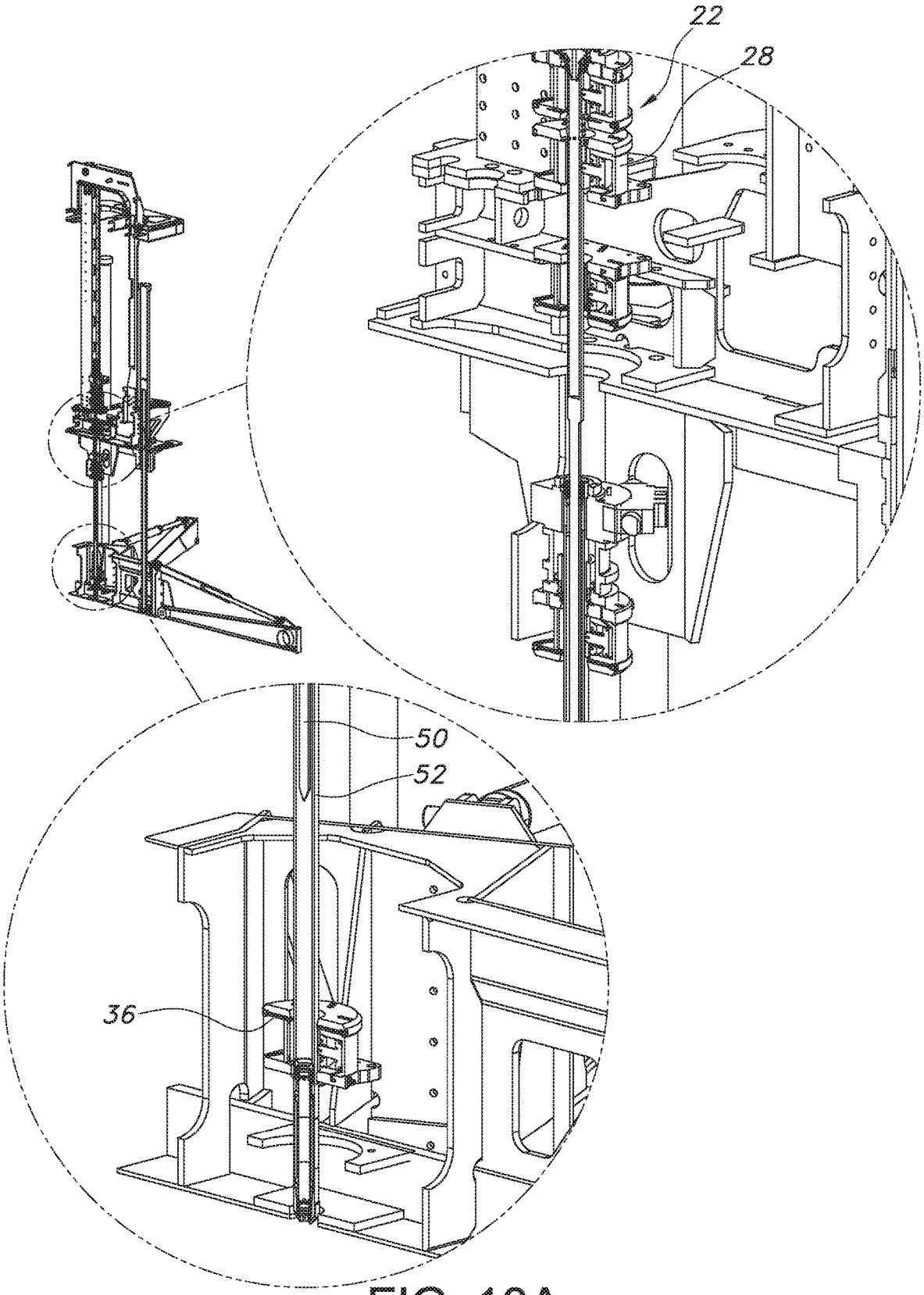
Figure 11:
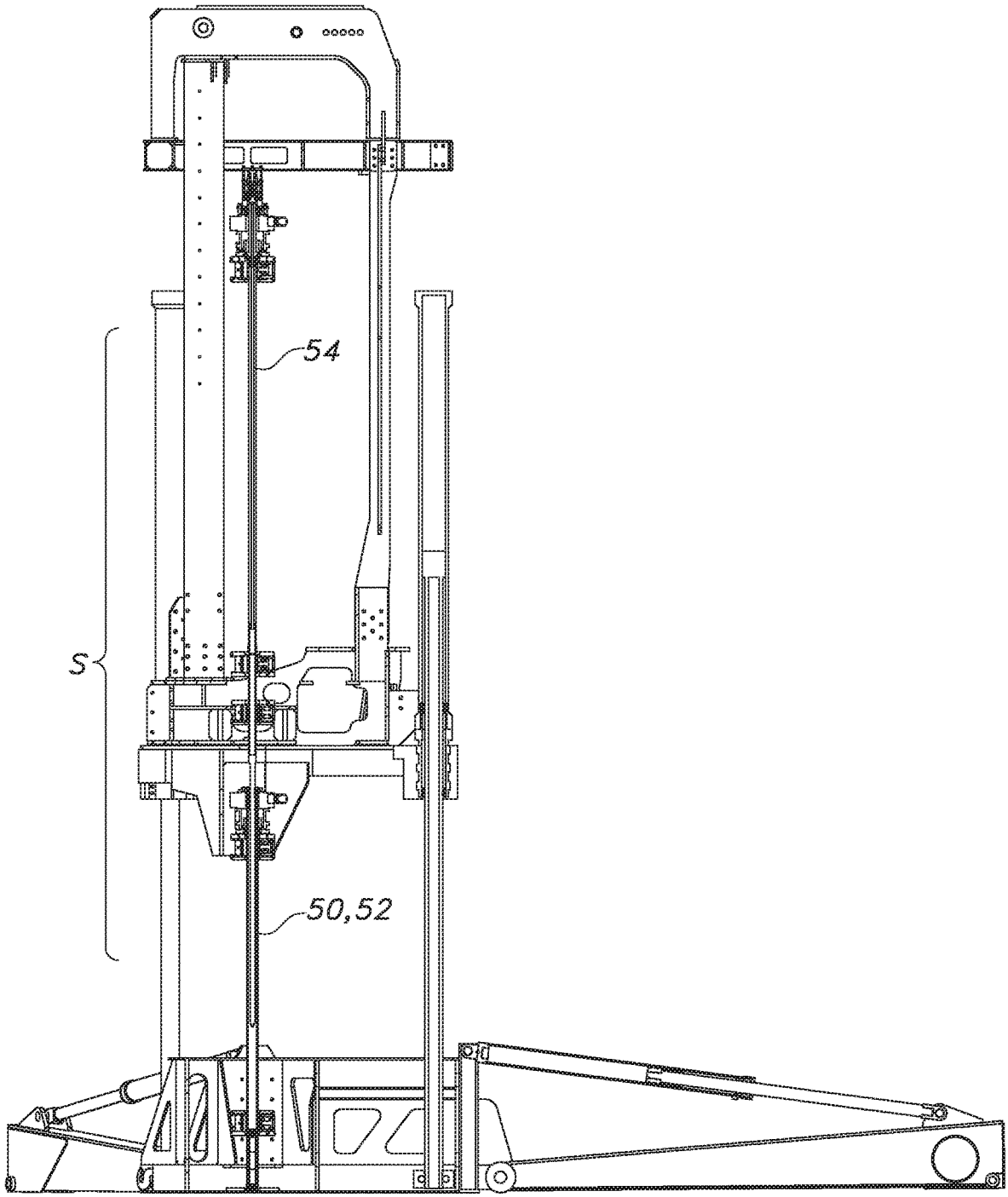
Figure 11A:
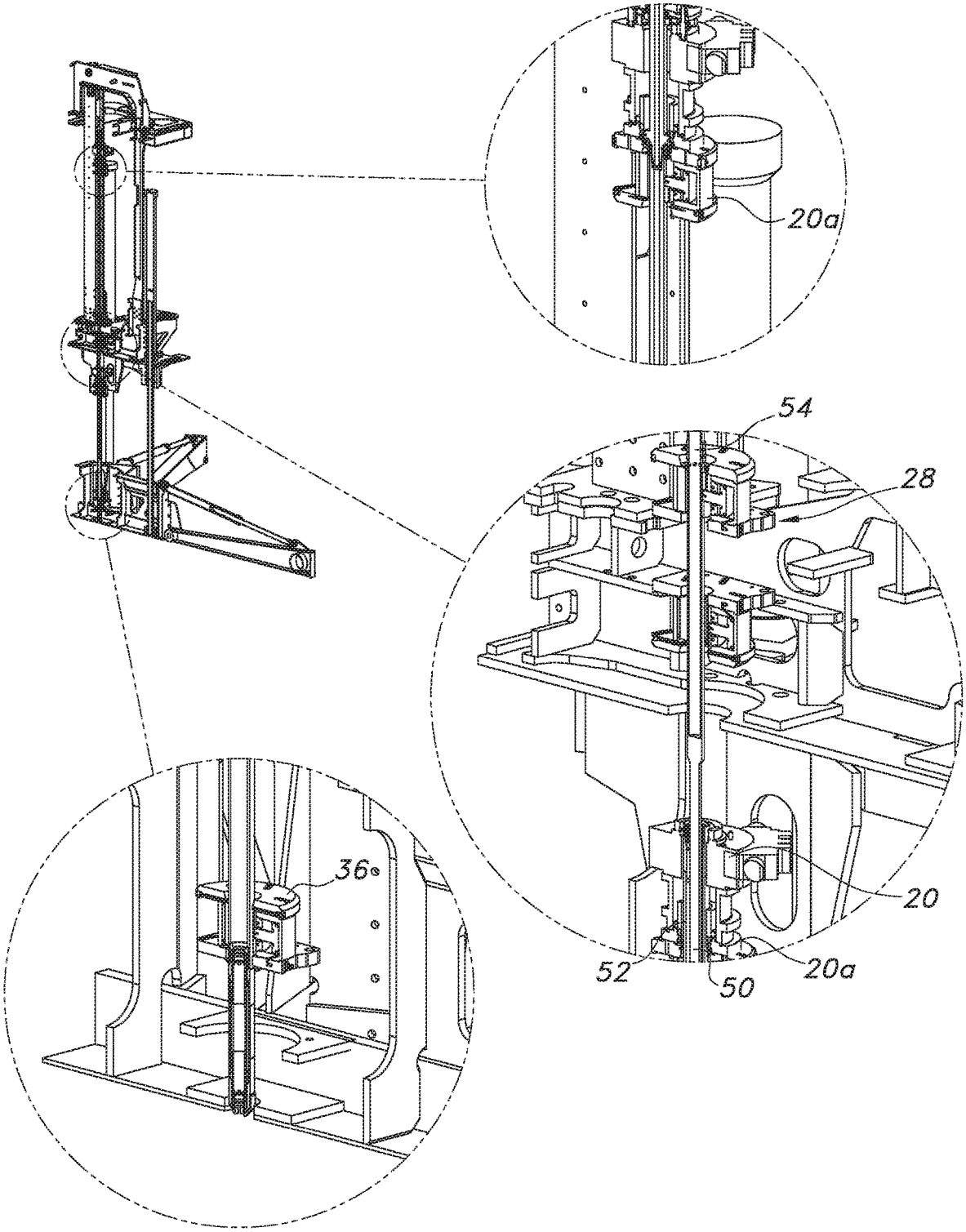
Figure 12:
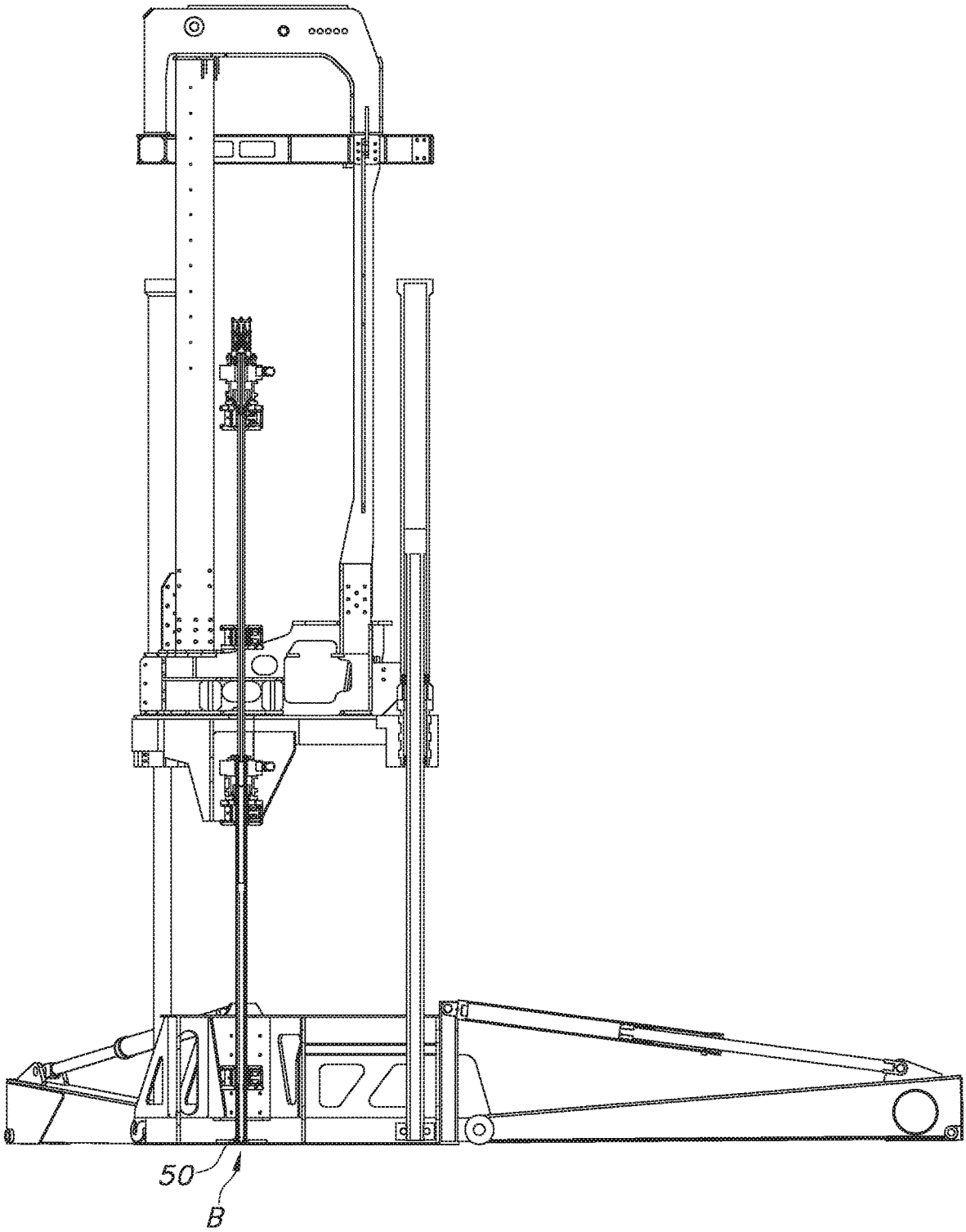
Figure 12A:
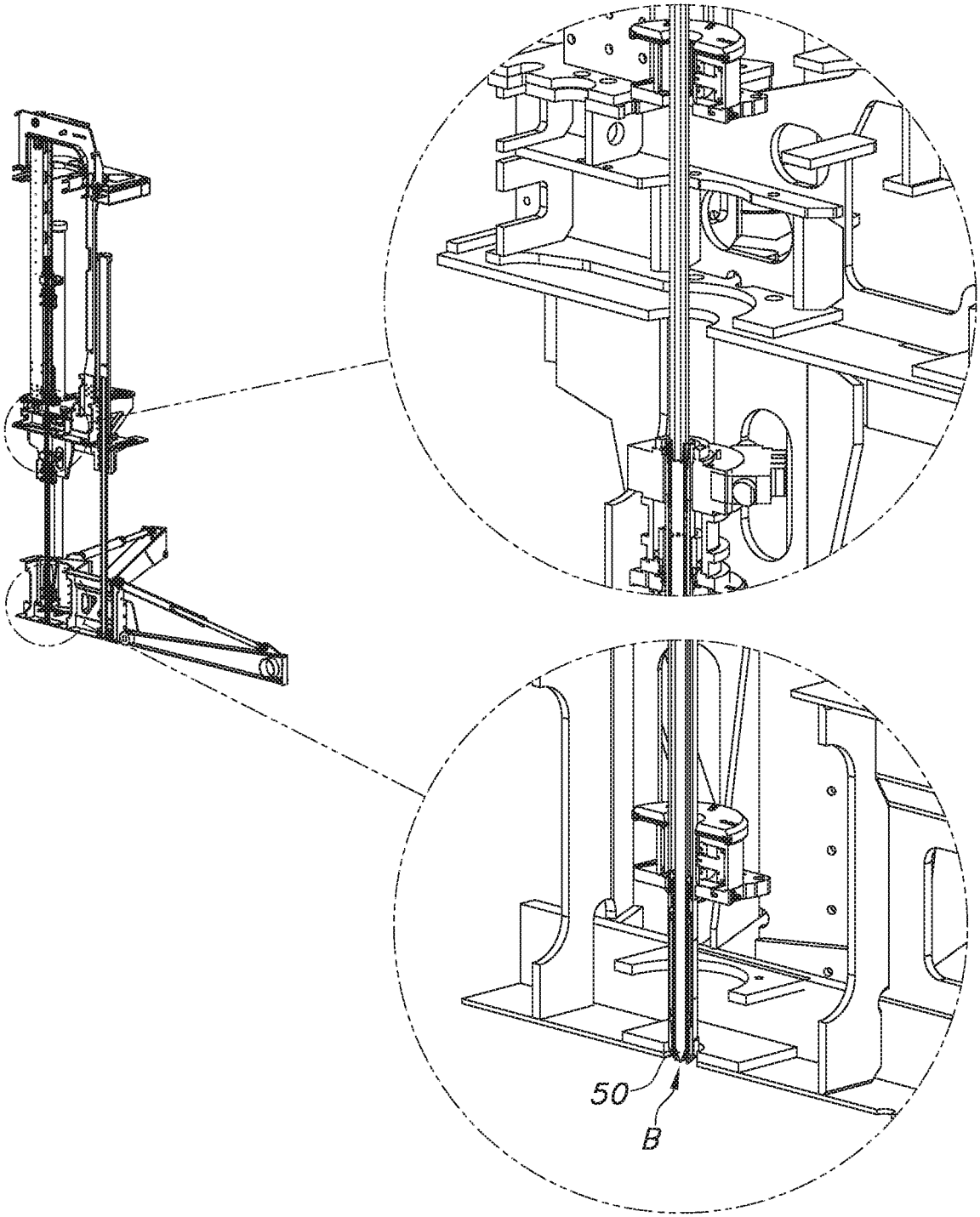
Figure 13:
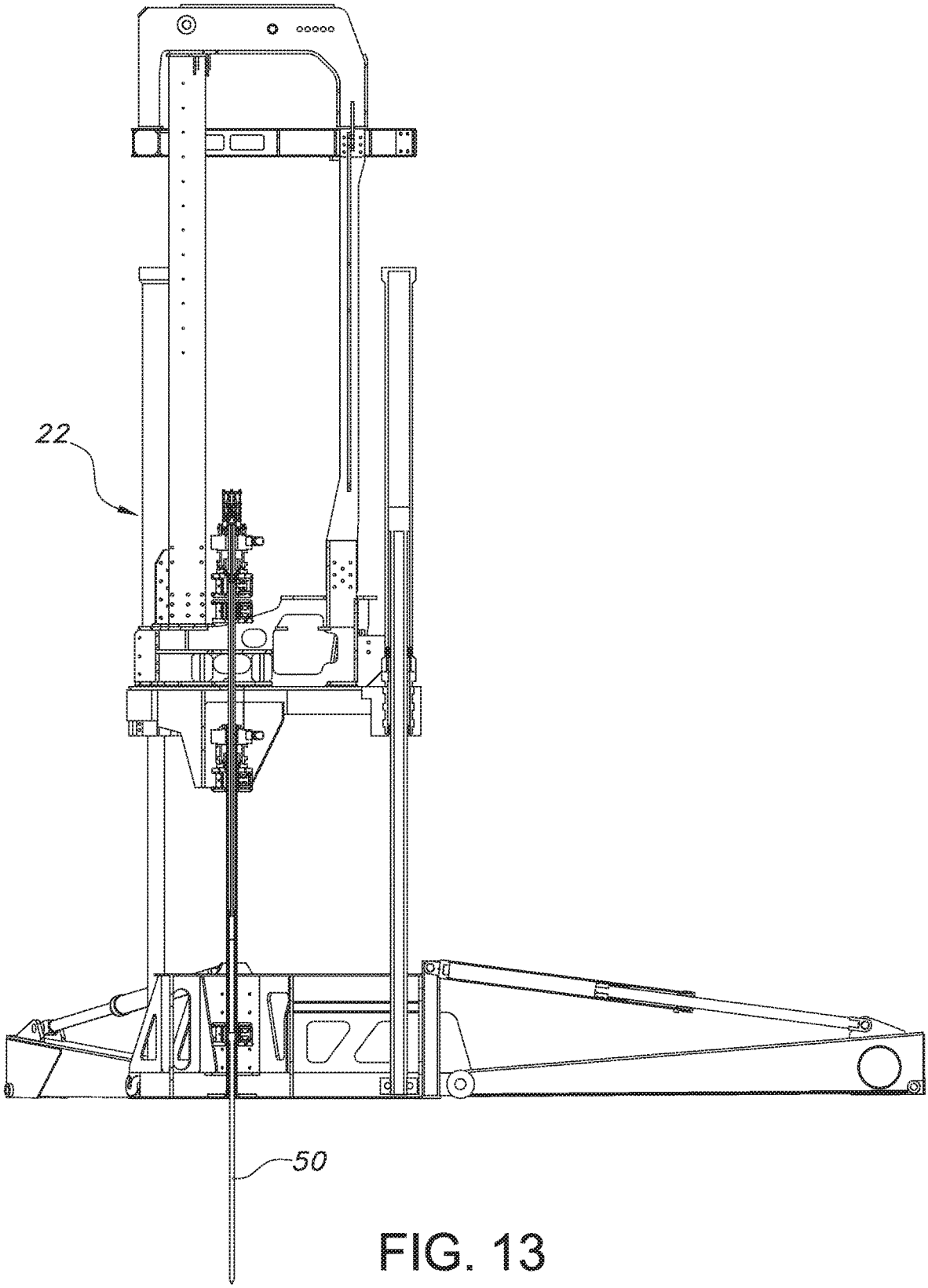
Figure 13A:
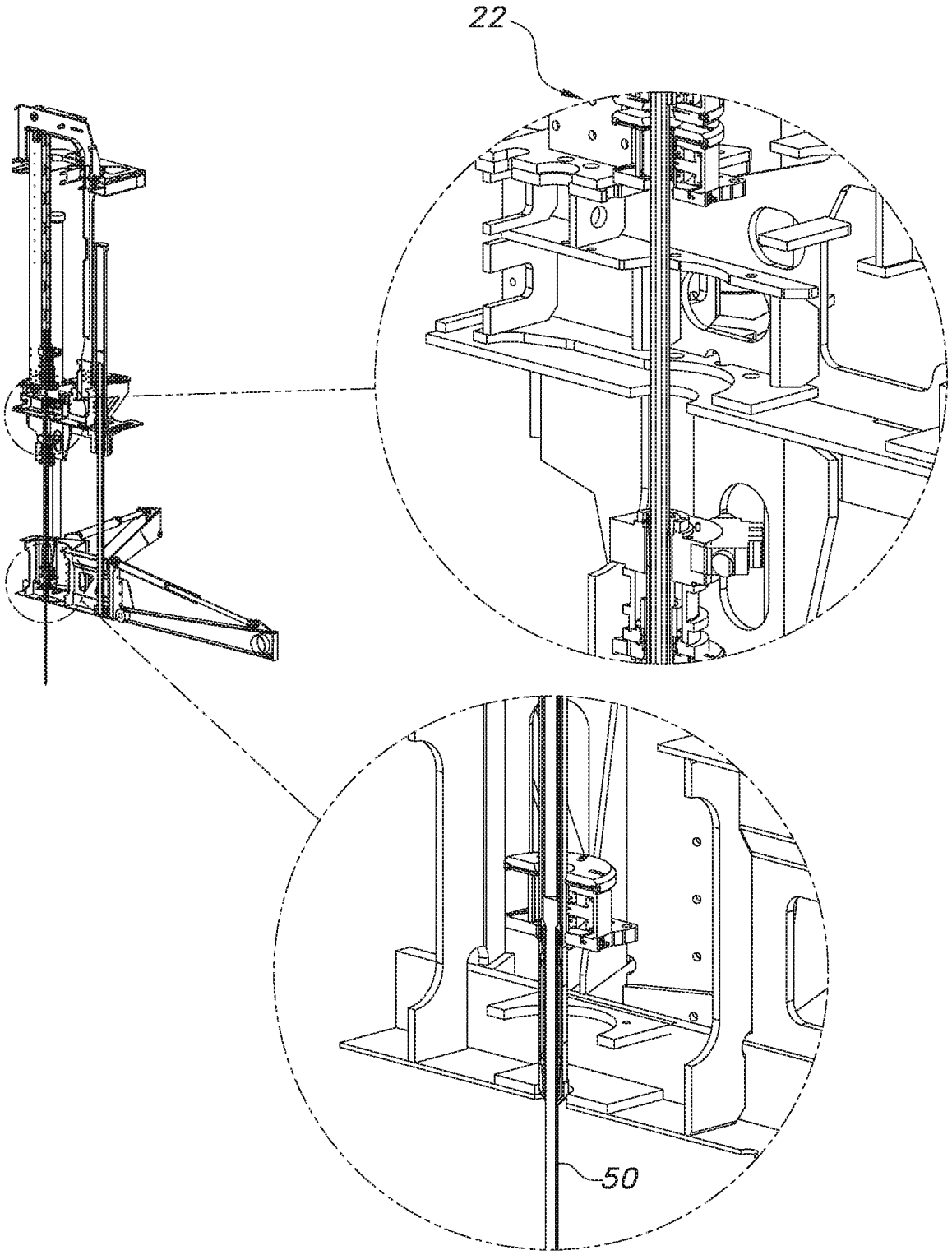
Figure 14:
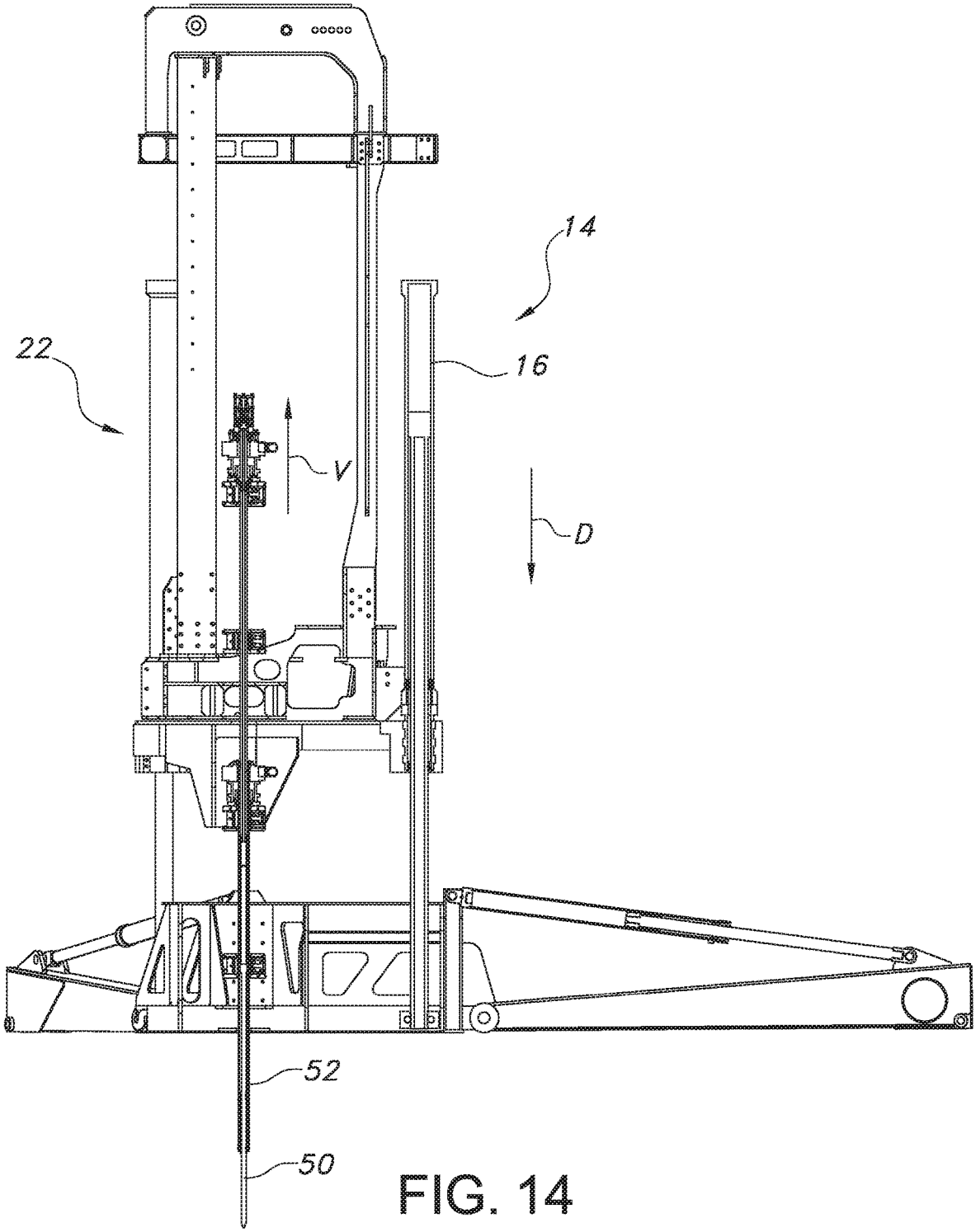
Figure 14A:
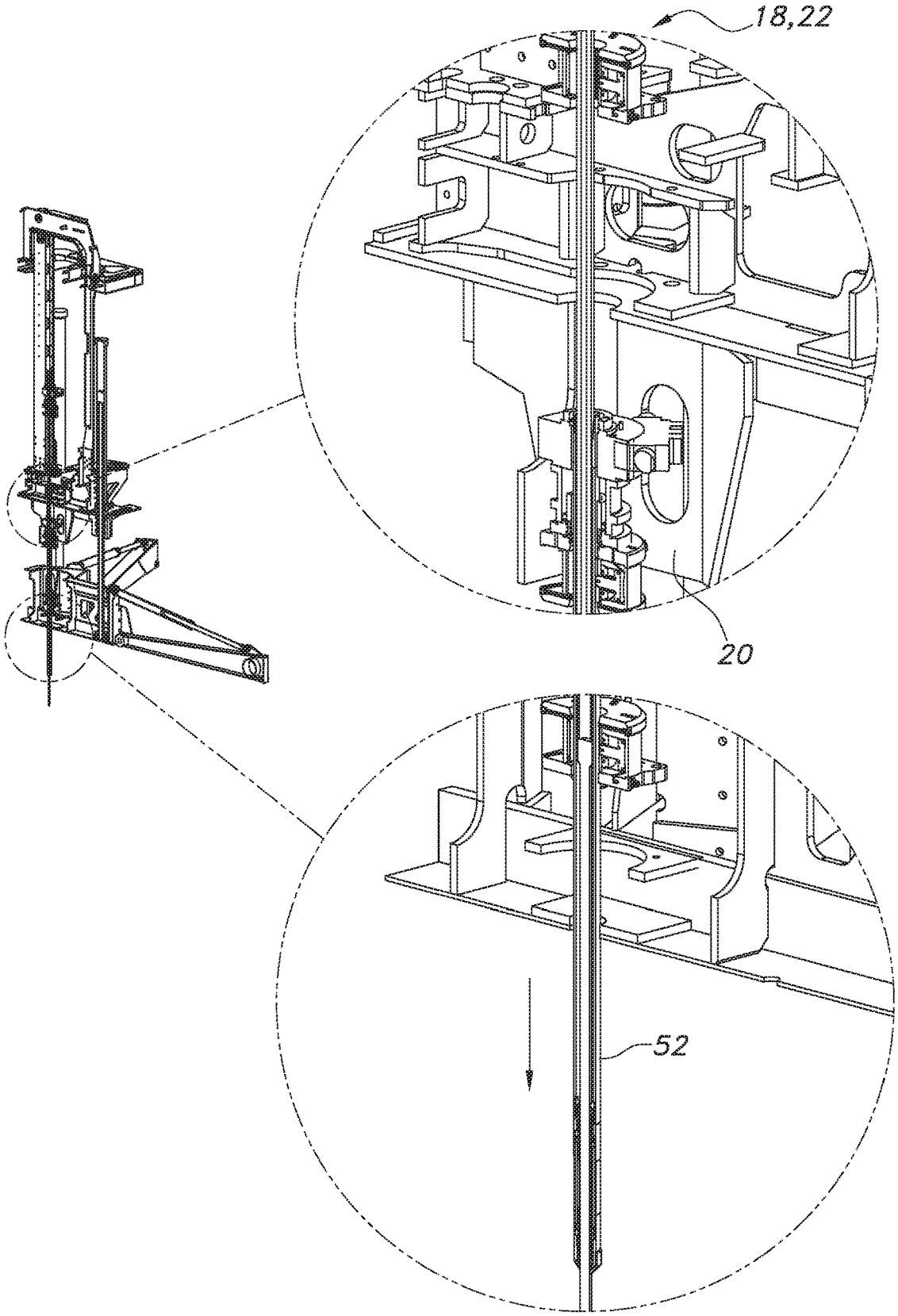
Figure 15:
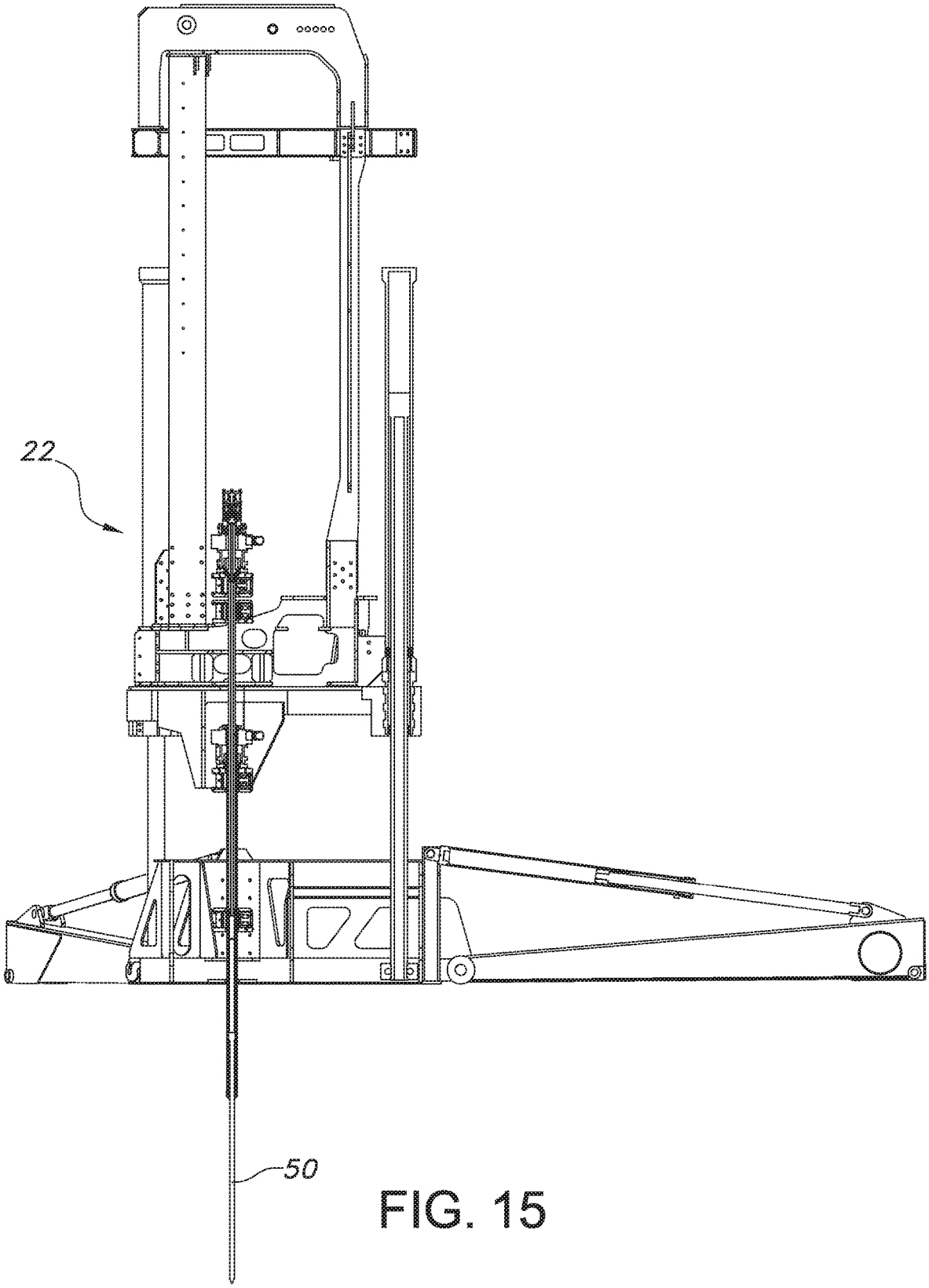
Figure 15A:
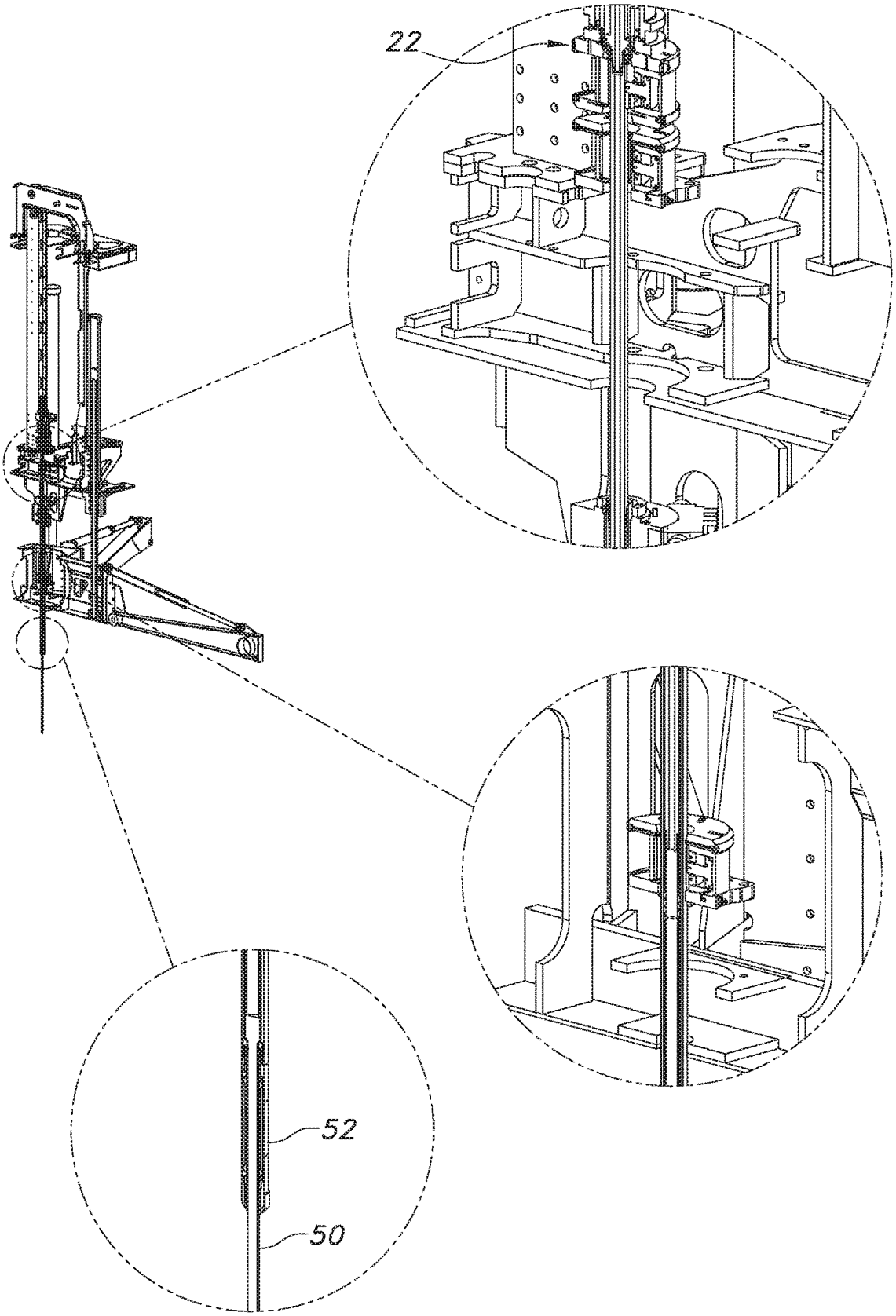

1. Start with DEP elevator (cylinders 16) at a desired (e.g., 750 mm) extension. FIGS. 8-8A.
2. Using the first (DMM) rotary unit 18 and elevator 22, advance a CPT washbore tool 52 so that the tip of the tool is at DEP base height B (FIG. 1), also as shown in FIGS. 8 and 8A. CPT washbore tool 52 may be typical in length (e.g., 3050 mm) for a washbore.
3. Clamp CPT washbore tool 52 with DEP casing clamp 36 and extend DEP elevator cylinders 16 to bring the top of CPT washbore tool 52 to DMM second rotary unit 20—FIGS. 9-9A. Close the chuck 20*a* on DMM second rotary unit 20 and open DEP casing clamp 36.
4. Run continuous CPT tool 50 to bottom position of DMM elevator 22 and close DMM rod clamp 28—FIGS. 9-9A, 10-10A. CPT tool 50 may be the typical tool length (e.g., 3050 mm overall, including a 750 mm sub section).
5. Add 1×CPT rod 54 to continuous CPT tool 50 to begin CPT string S with thread make up position located at normal make up height—FIGS. 11-11A. Rod clamp 28, chuck 20*a*, and casing clamp 36 are closed.
6. Advance CPT tool 50 and CPT rod 54, i.e., CPT string S, so that tip of CPT tool 50 is at DEP base height B—FIGS. 12-12A.
7. Commence CPT tool 50 push at 20 mm/s using only DMM elevator 22 until end of stroke. CPT tool shoulder 50*a* will be just behind CPT washbore bit 52*a* at this point—FIGS. 13-13A.
8. Halt progress of CPT tool 50, and commence "chase" drilling with the CPT washbore tool 52 using second rotary unit 20 and lowering DMM 14 using cylinders 16 while raising elevator 22 at same or similar rate to maintain CPT tool 50 stationary (note up and down arrows U, D), keeping a distance (e.g., 300 mm) between the CPT tool 50 and the CPT washbore tool 52. FIGS. 14-14A. Clamps remain as per step 6. The casing is advanced at the operator's discretion, but should not drill within a certain distance (e.g., 300 mm) of the CPT tool top so as to not disturb virgin ground.
9. With the DEP elevator 22, advance the CPT tool 50. FIGS. 15-15A.
10. Commence rotation of CPT washbore tool 52 and actuate DEP elevator cylinders 16 until further or completely retracted while simultaneously raising DMM elevator 22 at the same rate—FIGS. 16-16A. This keeps CPT rod string S 'stationary' in the borehole while also advancing casing string T.
11. Halt second rotary unit 20 to stop CPT washbore 52 rotation, hold DEP elevator cylinders 16 and continue advancing CPT tool 50 at 20 mm/s using first rotary unit 18 until end of stroke of DMM elevator 22—FIGS. 17-17A.

Figure 17:
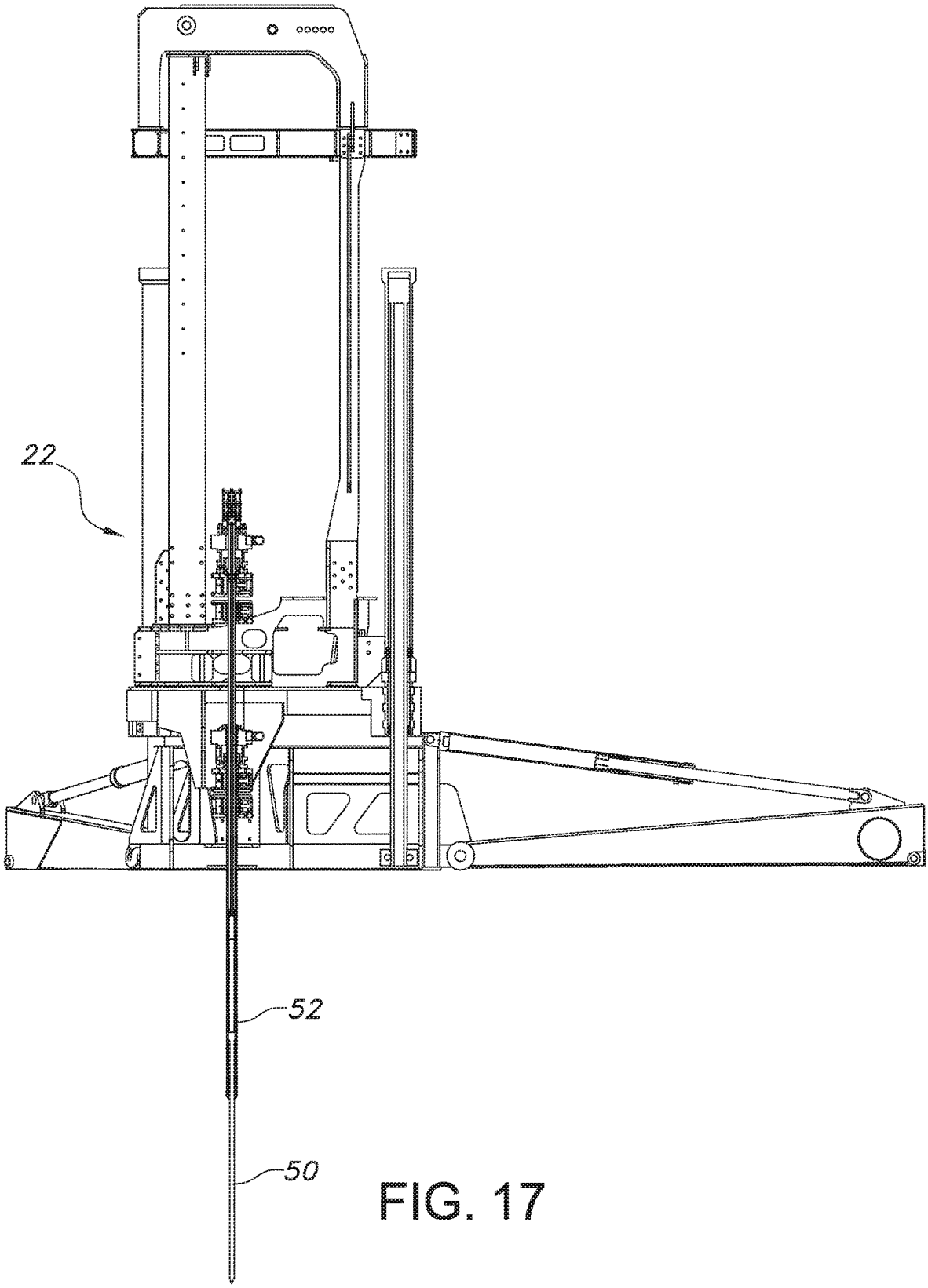
Figure 17A:
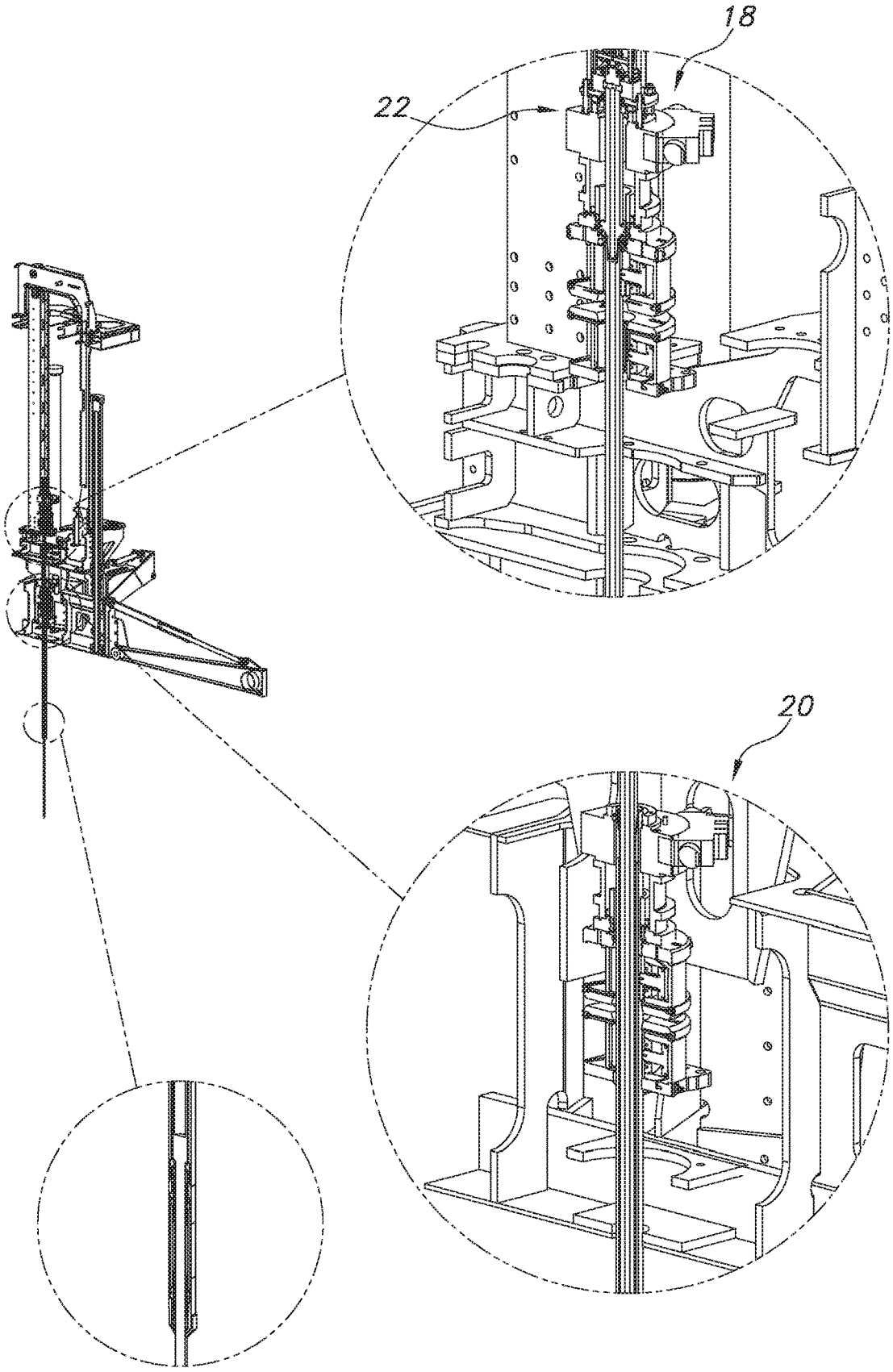
Figure 18:
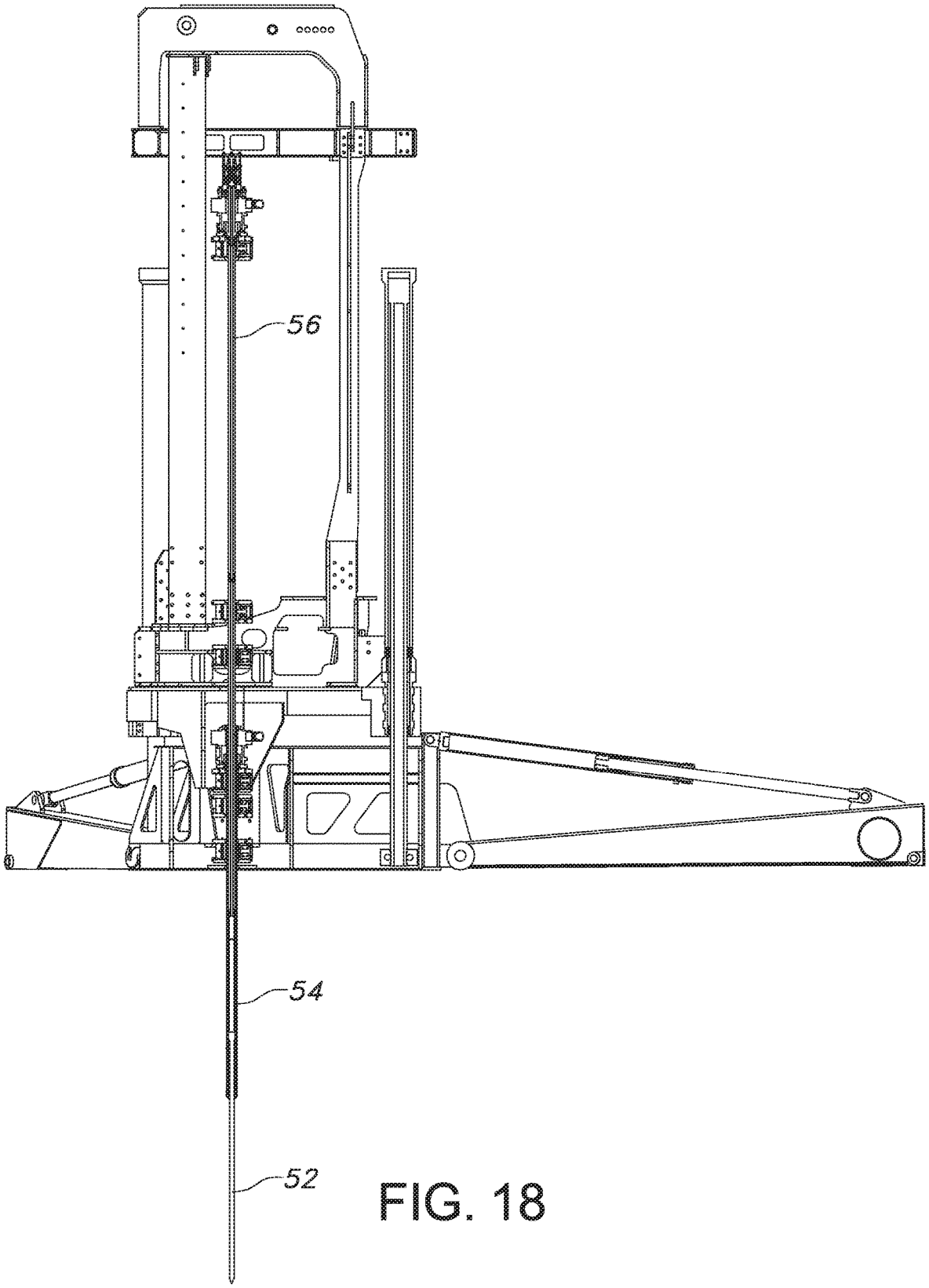
Figure 18A:
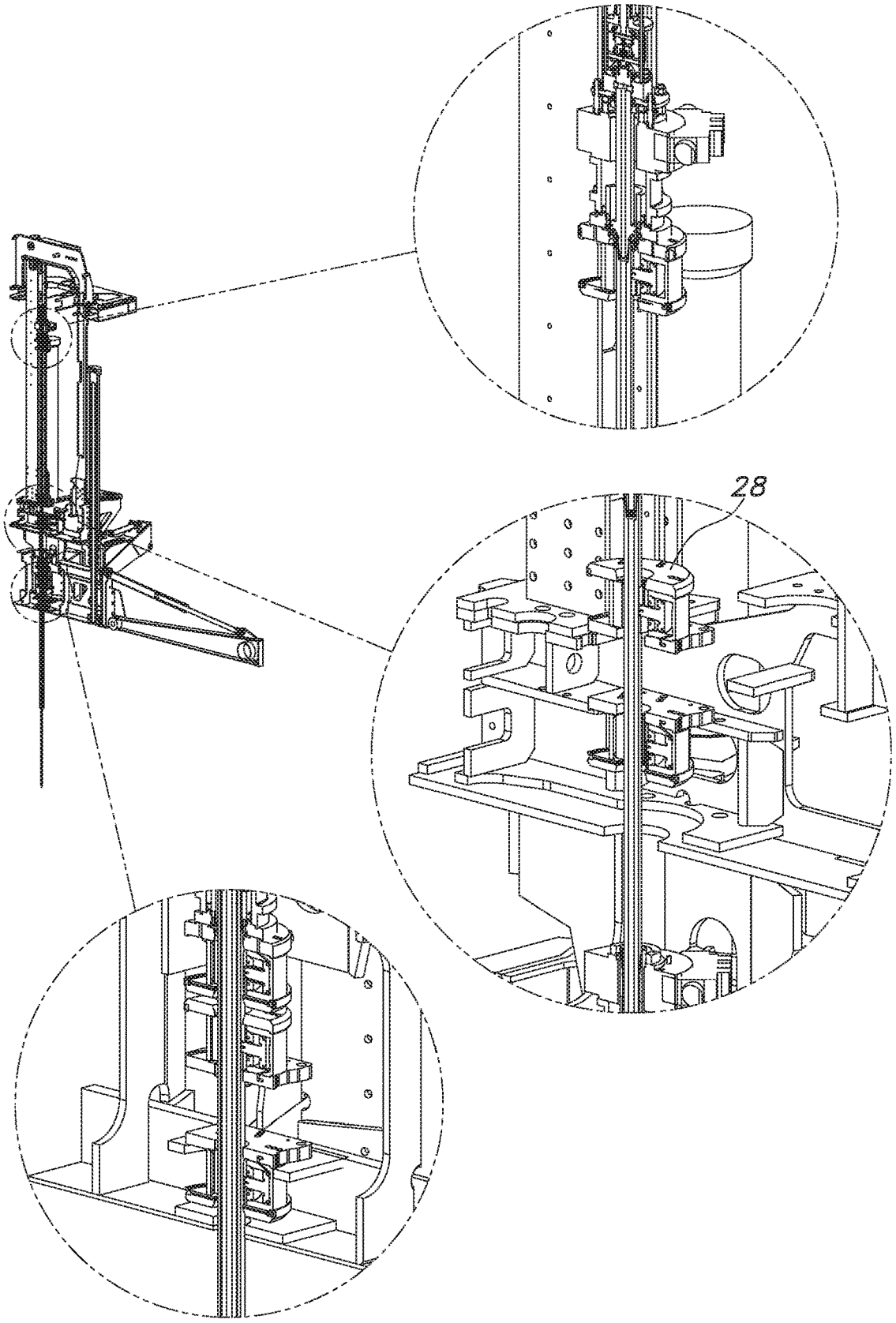
Figure 19:
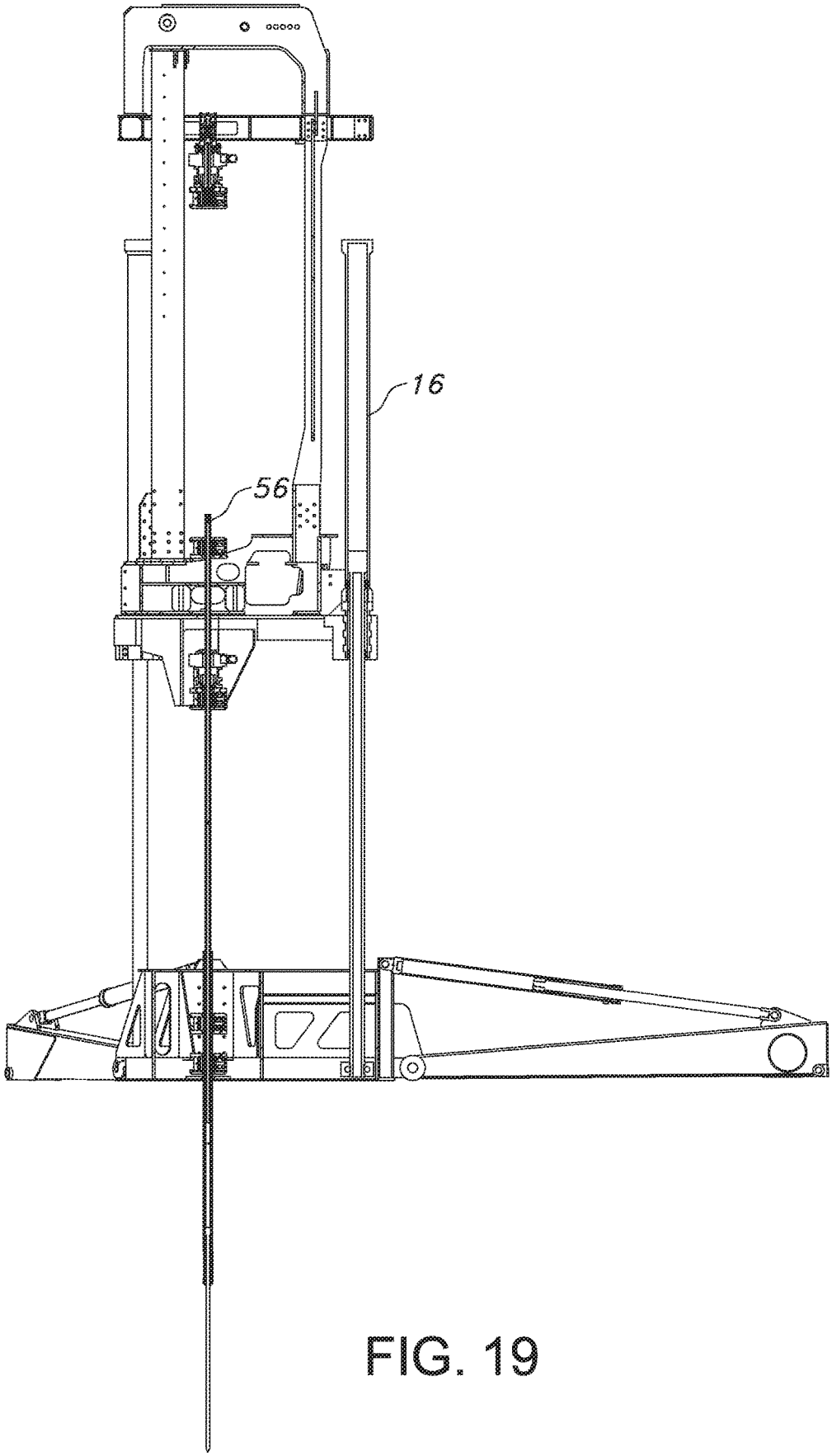
Figure 19A:
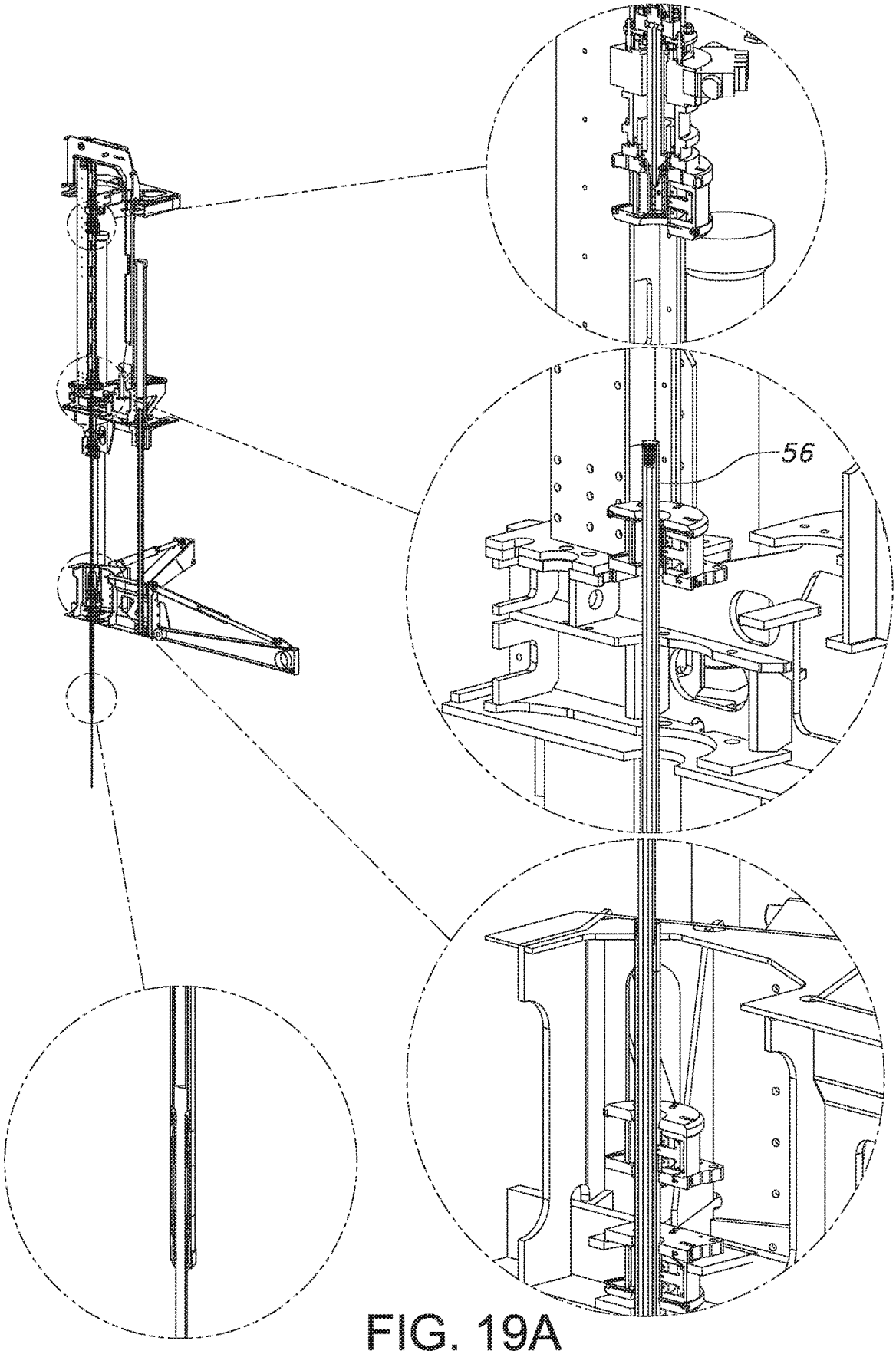
Figure 20:
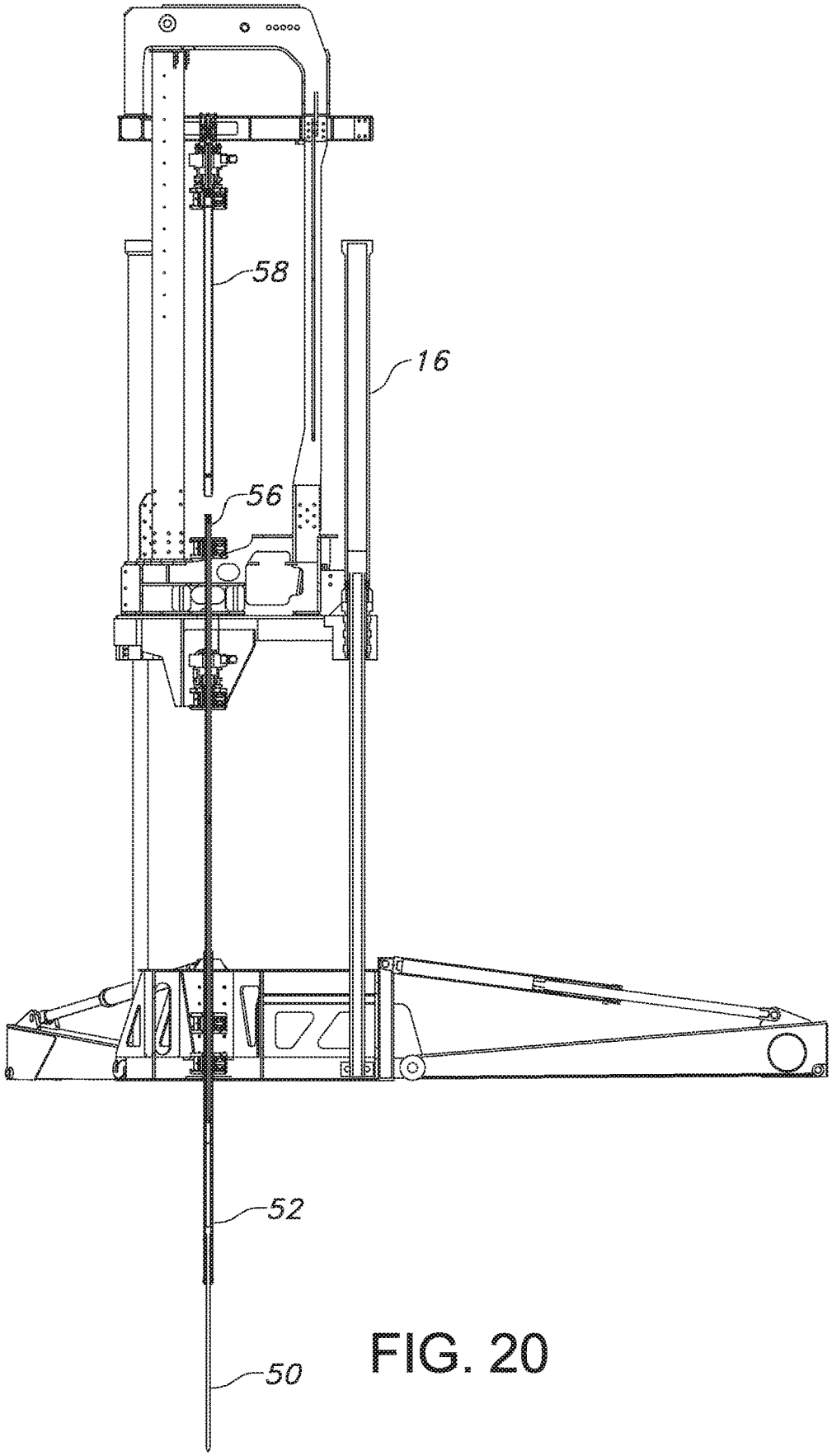
Figure 20A:
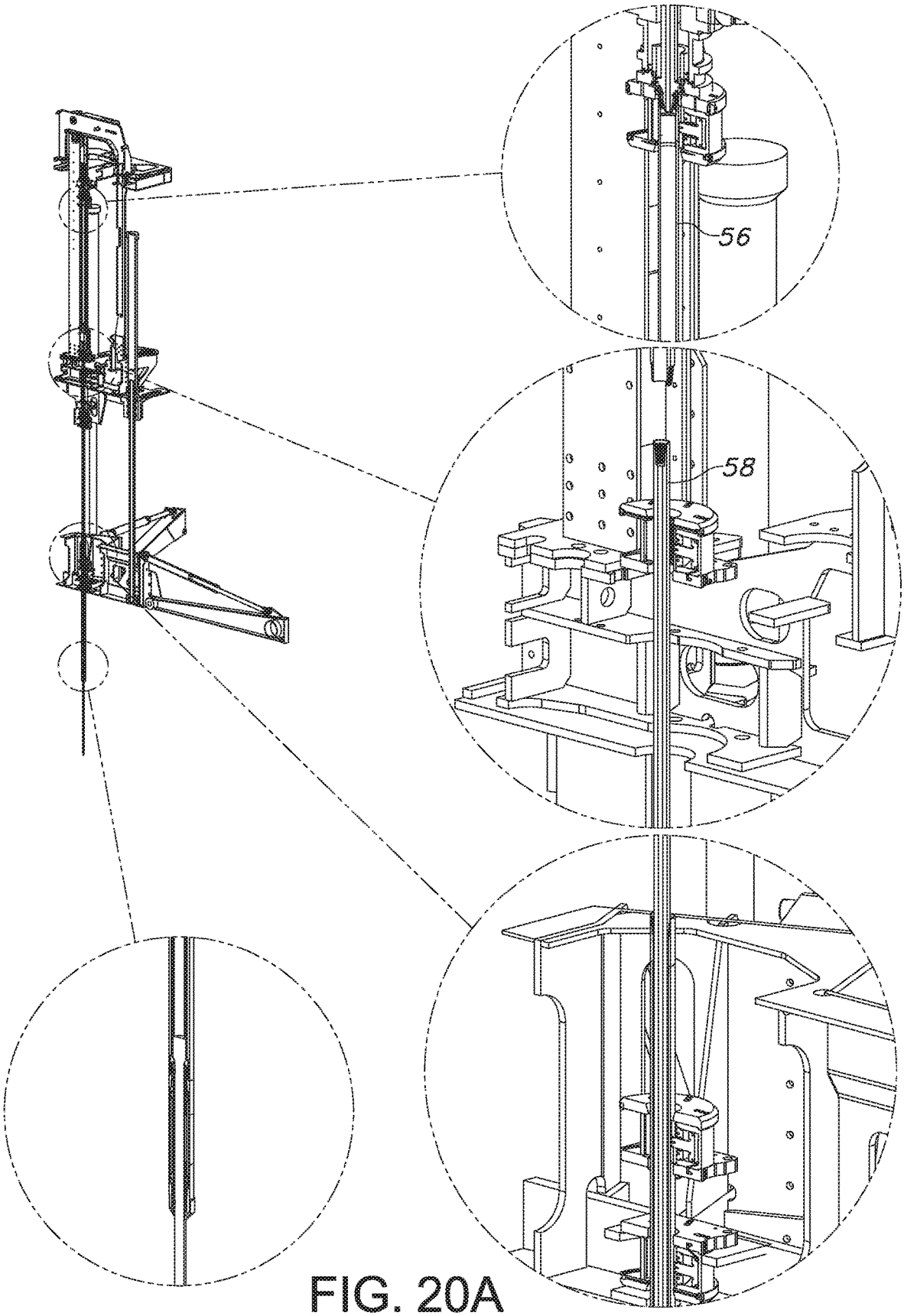
Figure 21:
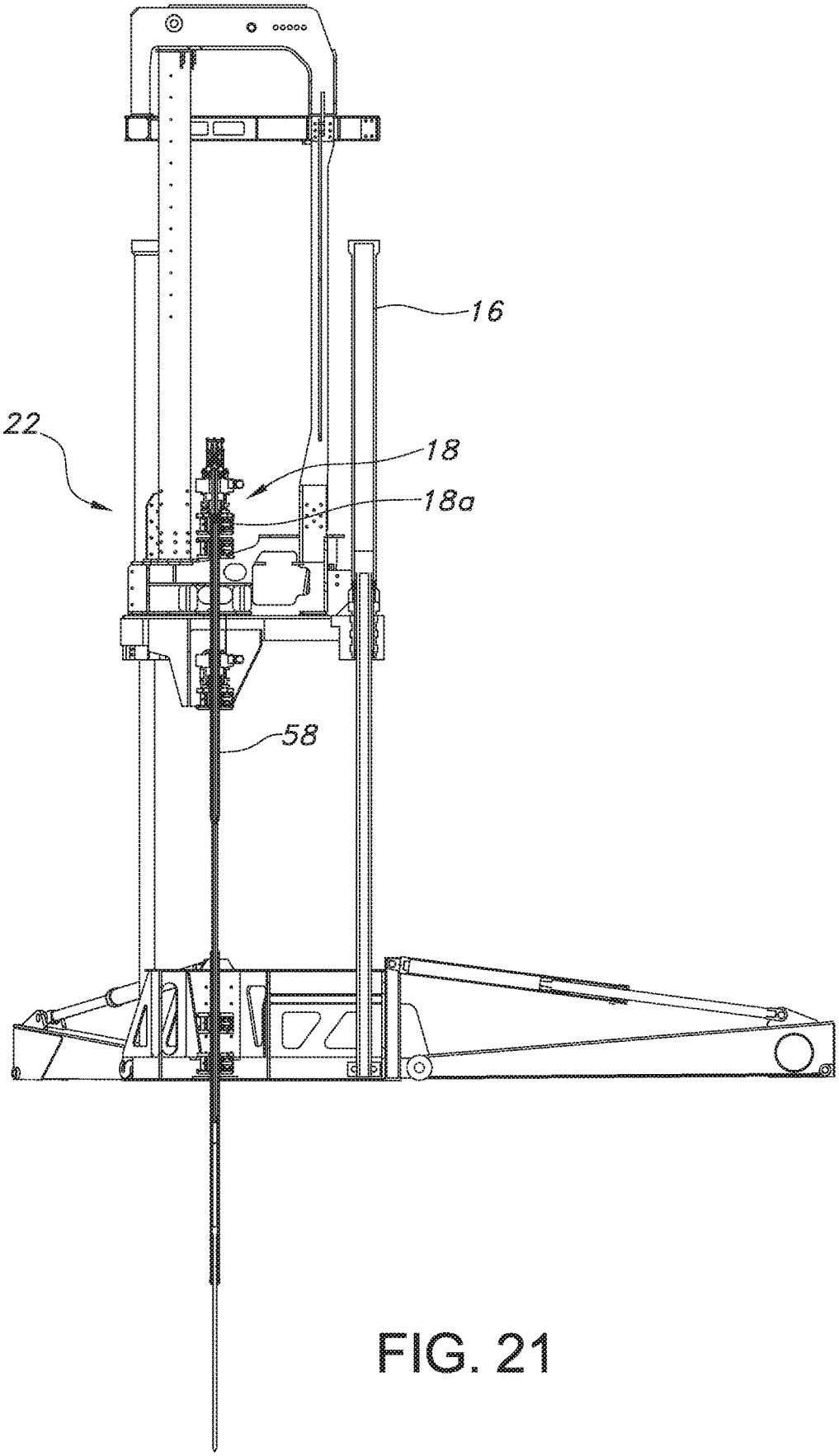
Figure 21A:
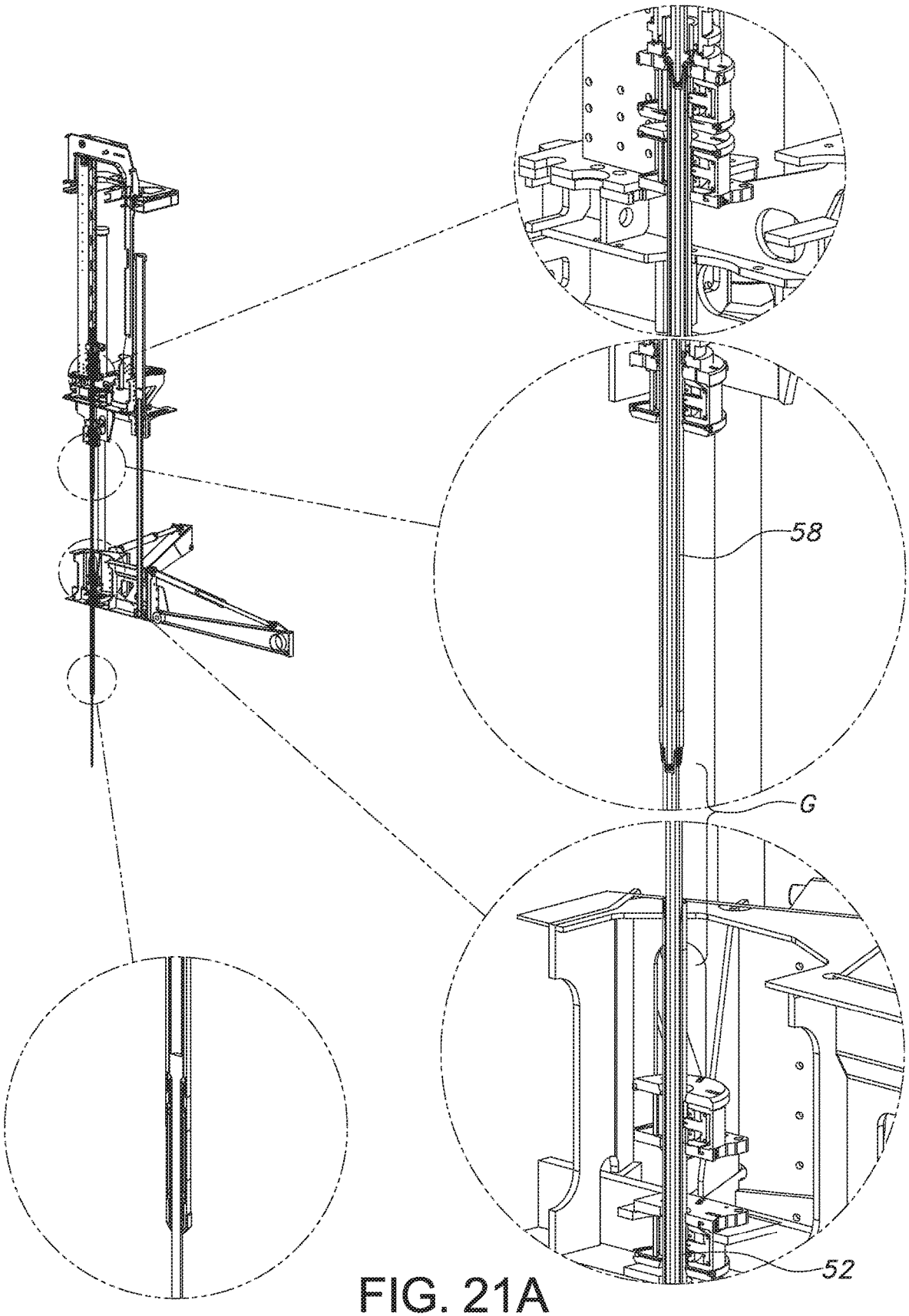
Figure 22:
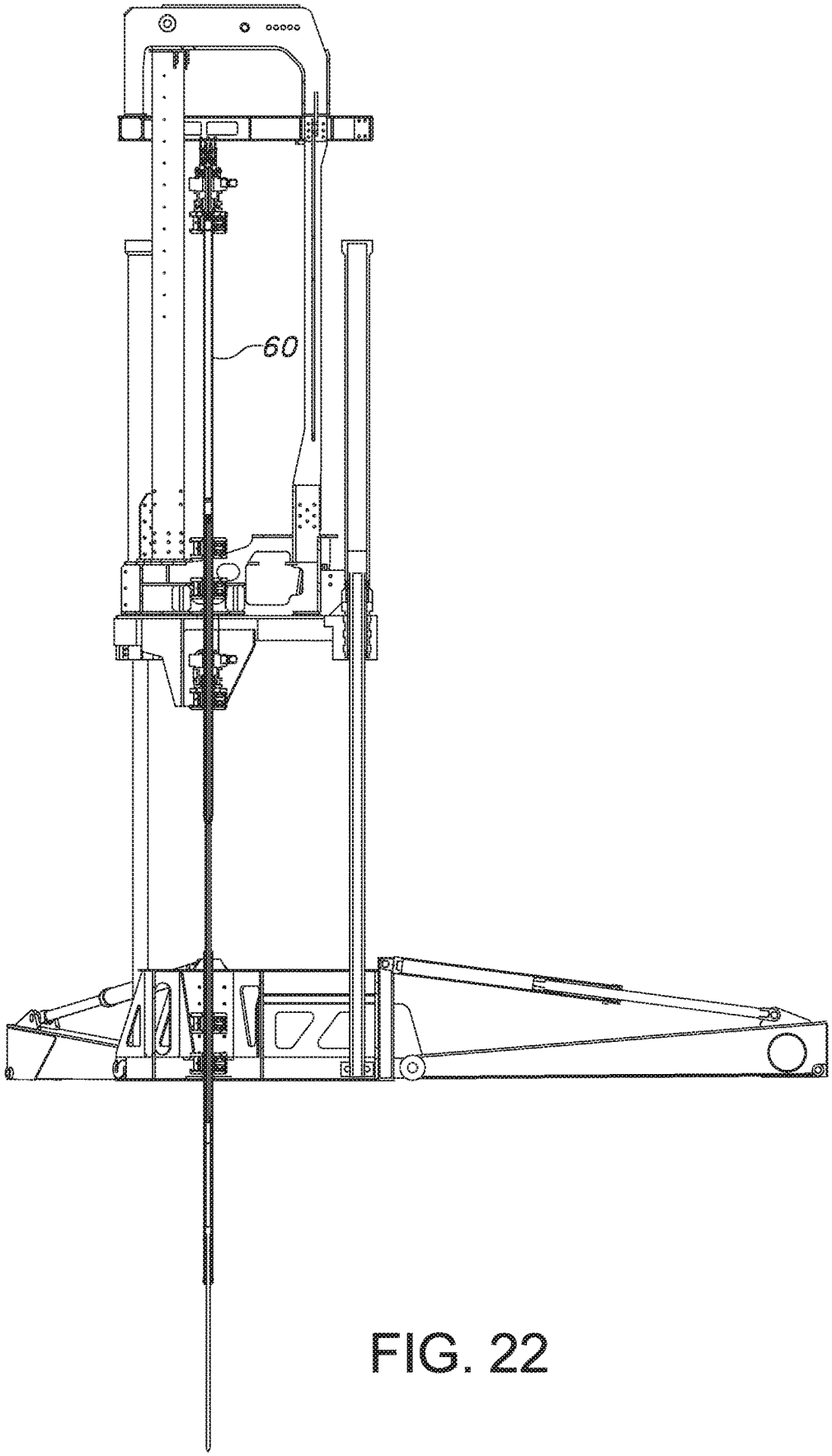
Figure 22A:
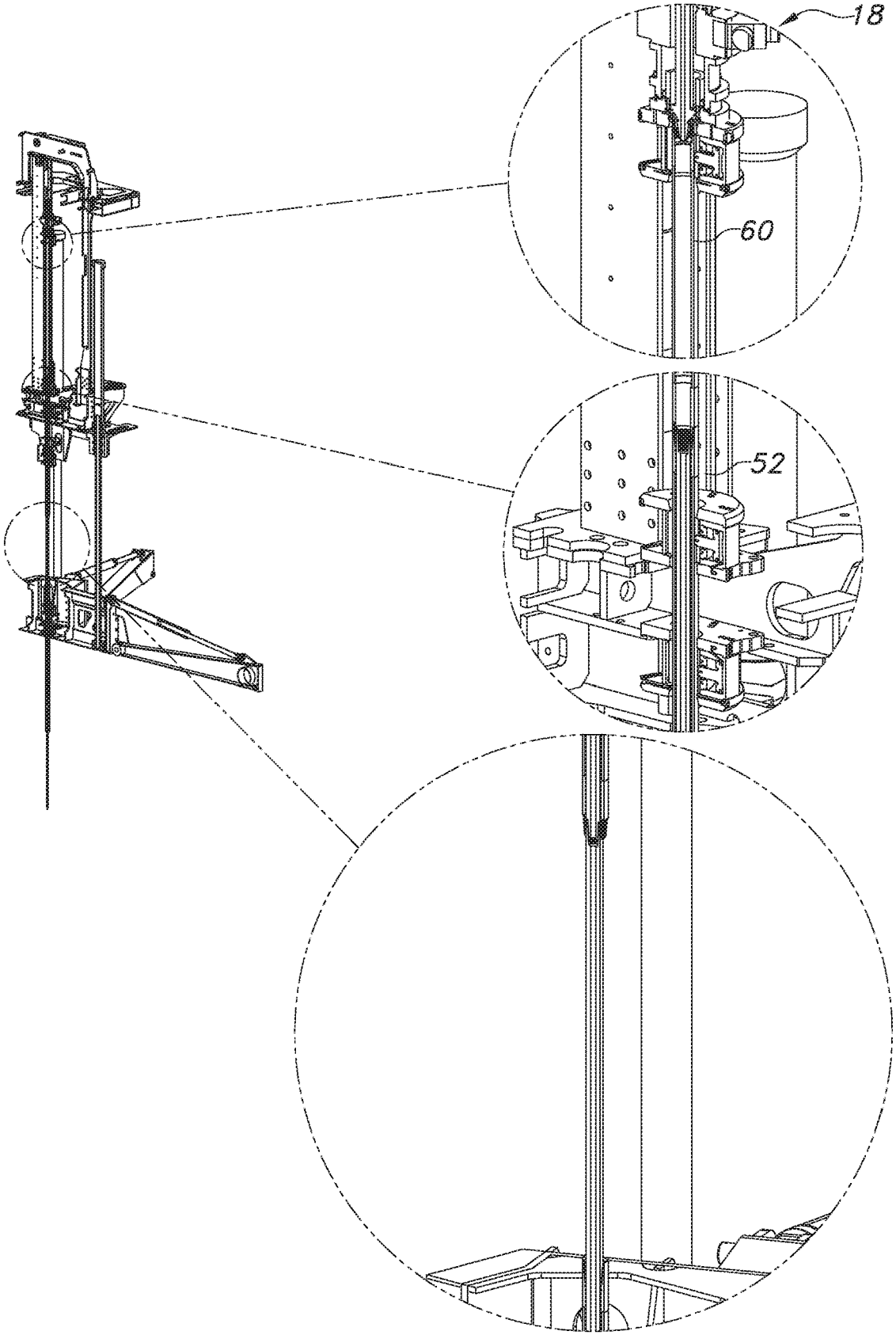
Figure 23:
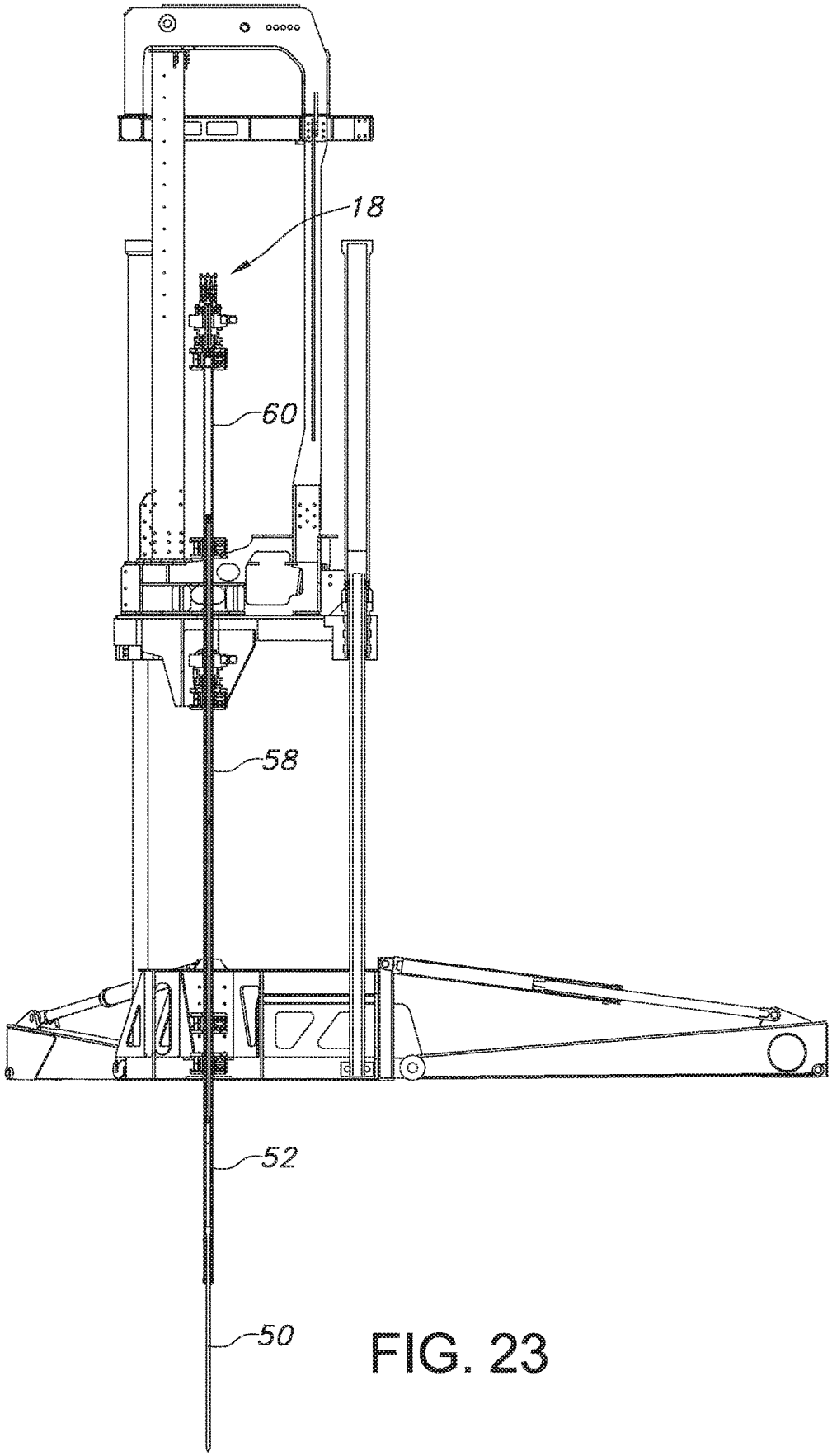
Figure 23A:
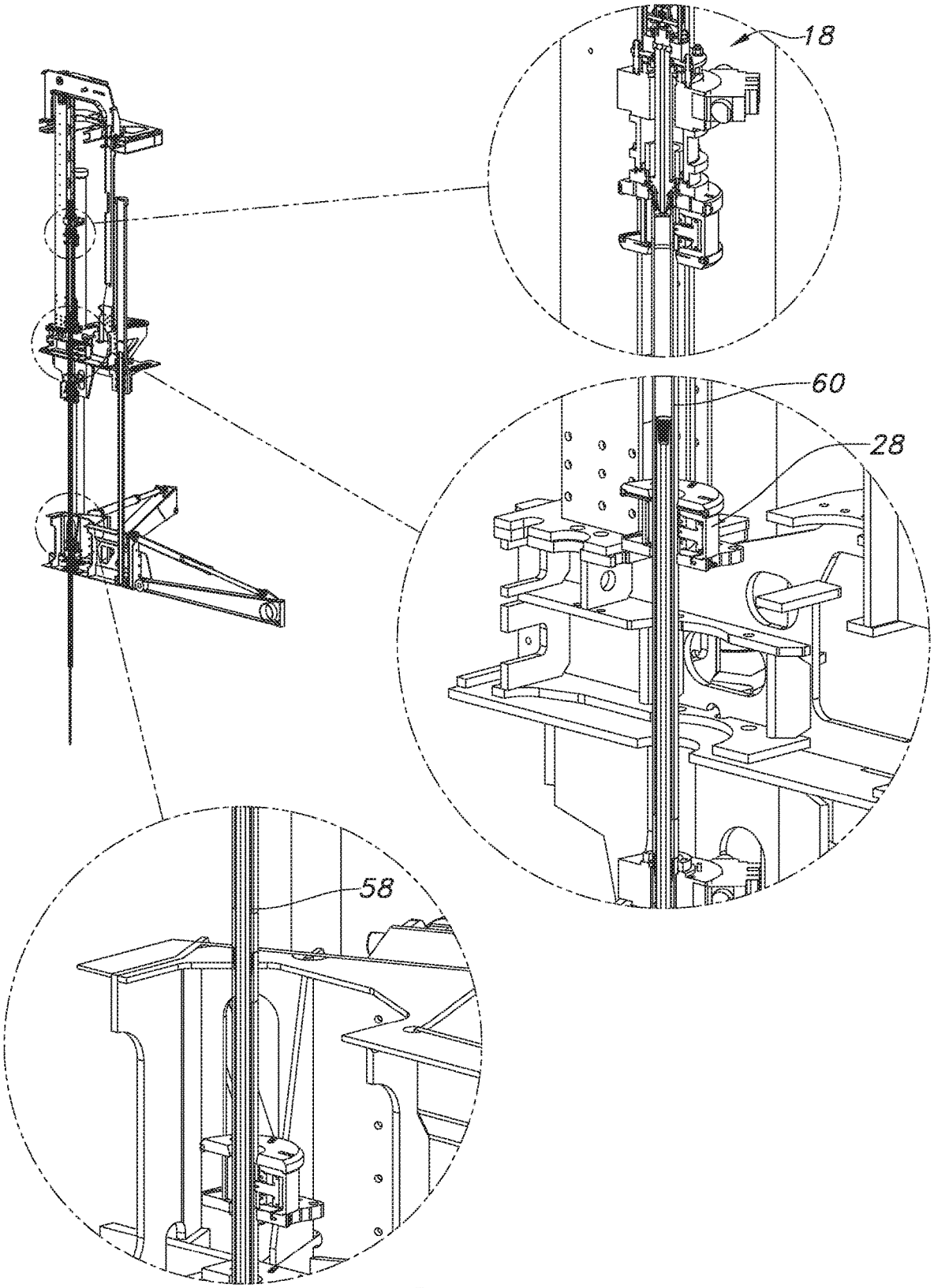
Figure 24:
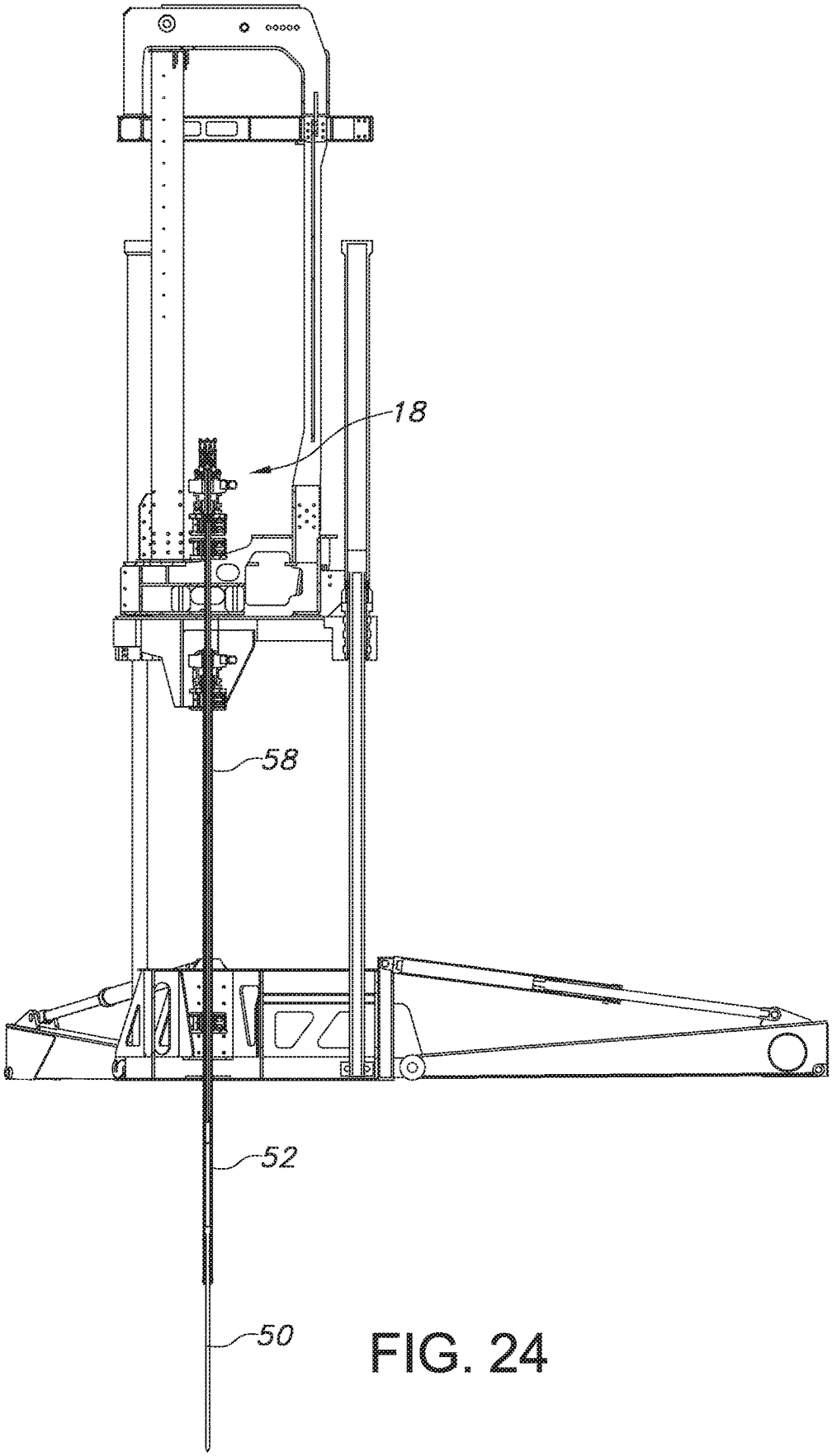
Figure 24A:
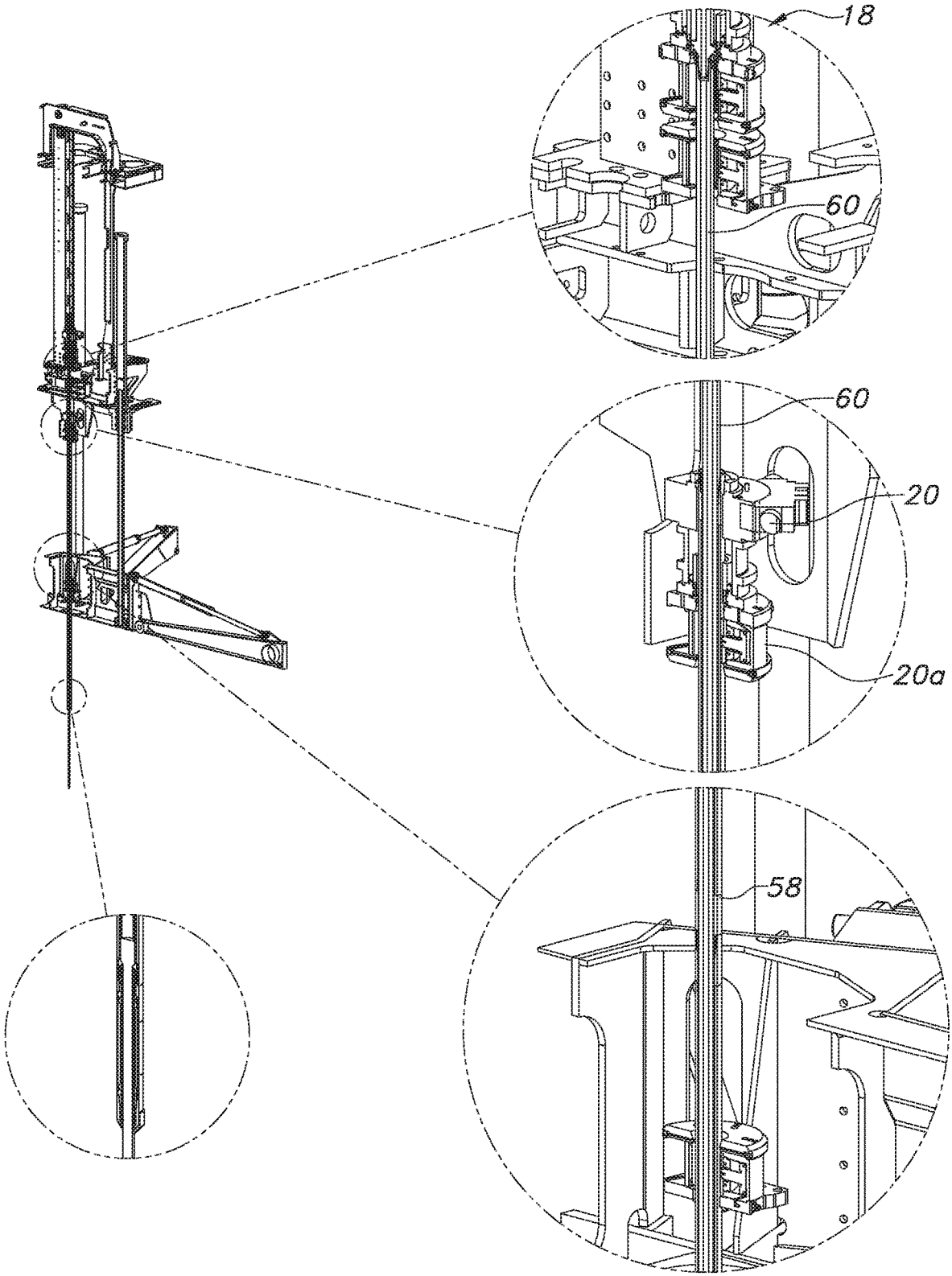

12. Close rod clamp 28 and add 1×CPT rod 56 to CPT rod 54 connected to CPT tool 50—FIGS. 18-18A.
13. Extend DEP elevator cylinders 16 by a distance (e.g., 2750 mm) to clear added CPT rod 56—FIGS. 19-19A.
14. Add CPT casing 58 over added rod 56—FIGS. 20-20A.
15. Lower added CPT casing 58 using first rotary unit 18 with clamp 18*a* closed to end of stroke of DMM elevator 22, with DEP cylinders 16 stationary, until the top of the CPT casing 58 and the CPT rod 56 are at the same or a similar height. FIGS. 21-21A. Note that a gap G remains between the CPT casing 58 and the downhole CPT washbore tool 52.
16. Add a CPT casing 60 to "bridge" the gap G. FIGS. 22-22A
17. Release rod clamp 28 and lower first rotary unit 18 and connect it to the CPT washbore tool 58. FIGS. 23-23A.
18. Clamp 20*a* is closed, and the CPT casing 60 is undone and removed. FIGS. 24-24A.
19. Essentially, repeat steps 7-11, such as by continuing to advance CPT tool 50 (via string S) at 20 mm/s for 1375 mm until DMM elevator 22 reaches end of stroke, and then "chase," which may be done in several (two or three) steps, as necessary to complete the full length of the desired CPT tool/washbore strings S, T.
20. At borehole complete, CPT casing string S and CPT tool/rod string T are recovered as per conventional routines.

There are further variations of sequence steps that may be used with the DEP system to deploy other types of tools in the borehole. Two such examples (not illustrated) are as follows:

Running a Core Sample Barrel (assuming DMM with DEP is levelled and ready to drill)

1. Run casing (spud casing in the first instance) to base B of DEP 12 and top of casing set at mud box height H (FIG. 1). DEP elevating cylinders 16 would be at approximately 60% extension.
2. Run core barrel also to base B of DEP 12. With casing set at mud box height H, the top of the core barrel will be at thread make height.
3. Add drill rod to back of core barrel.
4. Start rotation of both core barrel and casing.
5. If core barrel is a rotary type, advance core barrel and casing at the same time using only DEP elevator cylinders 16 to advance the borehole. The core barrel may be advanced 50 mm (or any desired amount) ahead of the casing if desired by the operator.
6. If core barrel is a non-rotational piston core type, the sampling stroke is activated first, then casing is advanced on completion of the stroke. If casing cannot be advanced following the core barrel push, a washbore will be required between runs.
7. Core barrel and casing are now advanced to the end of the DEP elevator stroke (DEP elevating cylinders 16 fully retracted). The DMM elevator 22 is not advanced—that is, the top of the core barrel is still at thread make height.
8. With DEP elevating cylinders 16 remaining retracted, pull drill rod (i.e. return to magazine).
9. Pull core barrel.
10. Add casing (below rod clamp 28).
11. Close DEP casing clamp 36, and open DMM casing clamp 30.
12. Extend DEP elevating cylinders 16 so that top of casing is at mud box height H.
13. Close DMM casing clamp 30, and open DEP casing clamp 36.
14. Repeat steps 2 to 13, increasing number of drill rods as required.
15. Once core barrel has returned to the designated magazine, a pull casing sequence can be activated from any position of DEP elevating cylinders 16.

This disclosure may be considered to pertain to the following items:

1. An apparatus for penetrating a seabed, comprising:
a drill assembly comprising first and second rotary units associated with a drilling axis, a base module adapted for engaging the seabed, an upper module, and a first elevator for moving the upper module relative to the base module along the drilling axis.

2. The apparatus of item 1, wherein the first elevator comprises at least one actuator for raising and lowering the upper module relative to the base module.

3. The apparatus of item 2, wherein the at least one actuator connects the upper module to the base module.

4. The apparatus of any of items 1-3, wherein the first elevator comprises a plurality of actuators, each connecting the upper module to the base module.

5. The apparatus of any of items 1-4, wherein the upper module includes the first and second rotary units.

6. The apparatus of any of items 1-5, further including a second elevator for raising and lowering the first rotary unit along the drilling axis.

7. The apparatus of any of items 1-6, further including a first drill tool, and wherein the upper module comprises at least one first clamp for clamping the first drill tool.

8. The apparatus of any of items 1-7, further including a second drill tool, and wherein the base module comprises at least one second clamp for clamping the second drill tool.

9. The apparatus of item 7 or item 8, wherein the first drill tool or second drill tool comprises one of a drill rod or a drill casing.

10. The apparatus of item 9, wherein the drill rod while clamped to the at least one first clamp is adapted for being received within the drill casing while clamped to the at least one second clamp.

11. The apparatus of item 9, wherein the upper module comprises a plurality of arms for associating the drill rod or drill casing with the first rotary unit.

12. The apparatus of any of items 1-12, wherein the base module comprises a plurality of feet adapted for engaging the seabed.

13. The apparatus of item 13, wherein each of the plurality of feet is associated with an actuator for moving the feet from a retracted position for being containerized to a deployed position for engaging the seabed.

14. A method for penetrating a seabed, comprising:
engaging a first drill rod with a first rotary unit adapted for moving along a drilling axis;
engaging a first drill casing adapted for receiving the drill rod with a second rotary unit adapted for moving along the drilling axis; and
independently moving the first and second rotary units along the drilling axis to cause the first drill rod and the first drill casing to penetrate the seabed.

15. The method of item 14, wherein the first and second rotary units are associated with an upper module, and the independently moving step comprises moving the upper module relative to the base module to move the first rotary unit relative to the second rotary unit to advance the first drill rod relative to the first drill casing.

16. The method of item 14 or item 15, further including the step of moving the first rotary unit relative to the second rotary unit without substantially moving the upper module relative to the base module.

17. The method of any of items 14-16, further including the step of adding a second drill rod to the first drill rod and engaging the second drill rod with the first rotary unit to further penetrate the seabed.

18. The method of any of items 14-17, further including the step of adding a second drill casing to the first drill casing and engaging the second drill casing with the second rotary unit to further penetrate the seabed.

19. The method of any of items 14-18, wherein the step of independently moving comprises simultaneously moving the first and second rotary units along the drilling axis to cause the first drill rod and the first drill casing to move in the same or opposite directions.

20. The apparatus or method of any of items 1-19, further a data logger or the step of logging data, such as using the first drill rod, if present.

21. A method for penetrating a seabed, comprising:

providing an upper module adapted for being raised and lowered relative to a base module;

inserting a first drill rod through a first drill casing to penetrate the seabed; and while holding the first drill rod stationary, lowering the upper module relative to the base module to cause the first drill casing the penetrate the seabed.

22. The method of item 21, wherein the upper module includes a first rotary unit, and the inserting step comprises rotating the first drill rod using the first rotary unit while advancing the first rotary unit.

23. The method of item 21 or item 22, wherein the upper module includes a second rotary unit, and the lowering step comprises rotating the first drill casing using the second rotary unit.

24. The method of any of items 21-23, further including the step of further inserting the first drill rod through the first drill casing to further penetrate the seabed.

25. The method of any of items 21-24, further including the step of connecting a second drill rod to the first drill rod during the further inserting step.

26. The method of any of items 21-25, further including the step of halting the first drill casing from advancing further or rotating prior to the further inserting step.

27. The method of any of items 21-26, further including the step of connecting a second drill casing to the first drill casing, and while holding the first and second drill rods from advancing, lowering the upper module relative to the base module to cause the connected first and second drill casings to advance.

28. The method of item 27, wherein the step of holding the first and second drill rods from advancing comprises raising the first rotary unit relative to the upper module at substantially the same rate as a rate of lowering the upper module relative to the base module.

29. The method of any of items 21-28, further including the step of logging data during the inserting step.

Each of the following terms written in singular grammatical form: "a", "an", and "the", as used herein, means "at least one", or "one or more". Use of the phrase "One or more" herein does not alter this intended meaning of "a", "an", or "the". Accordingly, the terms "a", "an", and "the", as used herein, may also refer to, and encompass, a plurality of the stated entity or object, unless otherwise specifically defined or stated herein, or the context clearly dictates otherwise. For example, the phrases: "a unit", "a device", "an assembly", "a mechanism", "a component", "an element", and "a step or procedure", as used herein, may also refer to, and encompass, a plurality of units, a plurality of devices, a plurality of assemblies, a plurality of mechanisms, a plurality of components, a plurality of elements, and, a plurality of steps or procedures, respectively.

Each of the following terms: "includes", "including", "has", "having", "comprises", and "comprising", and, their linguistic/grammatical variants, derivatives, or/and conjugates, as used herein, means "including, but not limited to", and is to be taken as specifying the stated components), feature(s), characteristic(s), parameter(s), integer(s), or step(s), and does not preclude addition of one or more additional component(s), feature(s), characteristic(s), parameter(s), integer(s), step(s), or groups thereof. Each of these terms is considered equivalent in meaning to the phrase "consisting essentially of." Each of the phrases "consisting of" and "consists of", as used herein, means "including and limited to". The phrase "consisting essentially of" means that the stated entity or item (system, system unit, system sub-unit device, assembly, sub-assembly, mechanism, structure, component element or, peripheral equipment utility, accessory, or material, method or process, step or procedure, sub-step or sub-procedure), which is an entirety or part of an exemplary embodiment of the disclosed invention, or/and which is used for implementing an exemplary embodiment of the disclosed invention, may include at least one additional feature or characteristic" being a system unit system sub-unit device, assembly, sub-assembly, mechanism, structure, component or element or, peripheral equipment utility, accessory, or material, step or procedure, sub-step or sub-procedure), but only if each such additional feature or characteristic" does not materially alter the basic novel and inventive characteristics or special technical features, of the claimed item.

The term "method", as used herein, refers to steps, procedures, manners, means, or/and techniques, for accomplishing a given task including, but not limited to, those steps, procedures, manners, means, or/and techniques, either known to, or readily developed from known steps, procedures, manners, means, or/and techniques, by practitioners in the relevant field(s) of the disclosed invention.

Terms of approximation, such as the terms about, substantially, approximately, etc., as used herein, refer to ±10% of the stated numerical value.

It is to be fully understood that certain aspects, characteristics, and features, of the invention, which are, for clarity, illustratively described and presented in the context or format of a plurality of separate embodiments, may also be illustratively described and presented in any suitable combination or sub-combination in the context or format of a single embodiment. Conversely, various aspects, characteristics, and features, of the invention which are illustratively described and presented in combination or sub-combination in the context or format of a single embodiment may also be illustratively described and presented in the context or format of a plurality of separate embodiments.

Although the invention has been illustratively described and presented by way of specific exemplary embodiments, and examples thereof, it is evident that many alternatives, modifications, or/and variations, thereof, will be apparent to those skilled in the art. Accordingly, it is intended that all such alternatives, modifications, or/and variations, fall within the spirit of, and are encompassed by, the broad scope of the appended claims.

The invention claimed is:

1. An apparatus for penetrating a seabed, comprising:

a drill assembly comprising an upper module including an upper rotary unit associated with a drilling axis and a lower rotary unit associated with the same drilling axis, the upper and lower rotary units being independently movable along the drilling axis, a base module adapted for engaging the seabed, and a first elevator for moving the upper module relative to the base module along the drilling axis.

2. The apparatus of claim 1, wherein the first elevator comprises a second actuator for raising and lowering the upper module relative to the base module.

3. The apparatus of claim 2, wherein the second actuator connects an upper platform of the upper module to a lower platform of the base module.

4. The apparatus of claim 1, wherein the first elevator comprises a plurality of actuators, each connecting the upper module to the base module.

5. The apparatus of claim 4, wherein the first actuator comprises a second elevator for raising and lowering the upper rotary unit along the drilling axis.

6. The apparatus of claim 1, further including a first drill tool, and wherein the upper module comprises at least one first clamp for clamping the first drill tool.

7. The apparatus of claim 6, further including a second drill tool, and wherein the base module comprises at least one second clamp for clamping the second drill tool.

8. The apparatus of claim 7, wherein the first drill tool or the second drill tool comprises one of a drill rod or a drill casing.

9. The apparatus of claim 8, wherein the drill rod while clamped to the at least one first clamp is adapted for being received within the drill casing while clamped to the at least one second clamp.

10. The apparatus of claim 8, wherein the upper module comprises a plurality of arms for associating the drill rod or drill casing with the upper rotary unit.

11. The apparatus of claim 8, wherein the first drill tool comprises a cone penetrometer test tool.

12. The apparatus of claim 1, wherein the base module comprises a plurality of feet adapted for engaging the seabed.

13. The apparatus of claim 12, wherein each of the plurality of feet is associated with an actuator for moving the feet from a retracted position for being containerized to a deployed position for engaging the seabed.

14. The apparatus of claim 1, wherein the upper module comprises upper and lower arms associated with the drilling axis for moving in tandem with the lower rotary unit.

15. A method for penetrating a seabed, comprising:

providing an upper module adapted for being raised and lowered relative to a base module;

inserting a first drill rod through a first drill casing to penetrate the seabed; and while holding the first drill rod stationary, lowering the upper module relative to the base module to cause the first drill casing to penetrate the seabed.

16. The method of claim 15, wherein the upper module includes a first rotary unit, and the inserting step comprises rotating the first drill rod using the first rotary unit while advancing the first rotary unit.

17. The method of claim 15, wherein the upper module includes a second rotary unit, and the lowering step comprises rotating the first drill casing using the second rotary unit.

18. The method of claim 15, further including the step of further inserting the first drill rod through the first drill casing to further penetrate the seabed.

19. The method of claim 18, further including the step of connecting a second drill rod to the first drill rod during the further inserting step.

20. The method of claim 19, further including the step of halting the first drill casing prior to the further inserting step.

21. The method of claim 20, further including the step of connecting a second drill casing to the first drill casing, and while holding the first and second drill rods from advancing, lowering the upper module relative to the base module to cause the connected first and second drill casings to advance.

22. The method of claim 21, wherein the step of holding the first and second drill rods from advancing comprises raising a first rotary unit connected to one of the first and second drill rods relative to the upper module at substantially the same rate as a rate of lowering the upper module relative to the base module.

23. The method of claim 15, further including the step of logging data during the inserting step.

24. The method of claim 15, wherein the step of holding the first drill rod stationary comprises holding the first drill rod vertically stationary relative to the base module.

25. An apparatus for penetrating a seabed, comprising:

an upper drill module including first and second rotary units and first and second clamps, all associated with a drilling axis;

a base module adapted for engaging the seabed, the base module including a third clamp associated with the same drilling axis; and a first elevator for moving the upper drill module relative to the base module along the drilling axis.

26. The apparatus of claim 25, wherein the upper module comprises upper and lower arms associated with the drilling axis for moving in tandem with the second rotary unit.

* * * * *